US008016654B2

(12) United States Patent
Kang

(10) Patent No.: US 8,016,654 B2
(45) Date of Patent: Sep. 13, 2011

(54) ARM-WRESTLING ROBOT AND THE CONTROL METHOD

(75) Inventor: Chul Goo Kang, Seoul (KR)

(73) Assignee: Konkuk University Industry Cooperation Foundation, Seoul (KR)

( * ) Notice: Subject to any disclaimer, the term of this patent is extended or adjusted under 35 U.S.C. 154(b) by 830 days.

(21) Appl. No.: 12/065,041

(22) PCT Filed: Mar. 21, 2006

(86) PCT No.: PCT/KR2006/001030

§ 371 (c)(1),
(2), (4) Date: Feb. 27, 2008

(87) PCT Pub. No.: WO2007/094529

PCT Pub. Date: Aug. 23, 2007

(65) Prior Publication Data

US 2008/0207289 A1 Aug. 28, 2008

(30) Foreign Application Priority Data

Feb. 13, 2006 (KR) ..... 10-2006-0013459

(51) Int. Cl.
*A63F 9/00* (2006.01)

(52) U.S. Cl. ..... 463/7; 901/2

(58) Field of Classification Search ..... 29/712; 463/7, 8, 23; 601/5; 700/253, 258, 261; 901/2, 3, 5

See application file for complete search history.

(56) References Cited

U.S. PATENT DOCUMENTS

| | | | | |
|---|---|---|---|---|
| 3,400,793 | A | 9/1968 | Norris et al. | |
| 3,662,602 | A | 5/1972 | Weiss | |
| 3,947,025 | A | 3/1976 | Hobby, Jr. | |
| 4,406,454 | A | 9/1983 | Dean | |
| 4,754,964 | A | 7/1988 | Michaels | |
| 4,900,019 | A | 2/1990 | Shamir | |
| 5,431,616 | A | 7/1995 | Centofante | |
| 5,458,554 | A | 10/1995 | Lo | |
| 5,842,958 | A | 12/1998 | Rufa | |
| 6,066,075 | A * | 5/2000 | Poulton | 482/8 |
| 6,652,428 | B2 | 11/2003 | Meller et al. | |
| 2001/0045941 | A1 * | 11/2001 | Rosenberg et al. | 345/161 |
| 2004/0243027 | A1 * | 12/2004 | Hook | 601/33 |
| 2004/0259689 | A1 * | 12/2004 | Wilkins et al. | 482/8 |
| 2006/0106326 | A1 * | 5/2006 | Krebs et al. | 601/40 |
| 2009/0062698 | A1 * | 3/2009 | Einav et al. | 601/5 |

FOREIGN PATENT DOCUMENTS

| | | |
|---|---|---|
| CN | 2691654 | 4/2005 |
| JP | 54-161436 | 12/1979 |
| JP | 55-54969 | 4/1980 |
| RU | 2128539 | 4/1999 |

OTHER PUBLICATIONS

"Conceptual Design for Robotic Arm Wrestling," written by Kang, et al., published by IEEE, Conference on Robotics, Automation and Machatronics, pp. 1072 to 1076.*

* cited by examiner

*Primary Examiner* — Dmitry Suhol

*Assistant Examiner* — Jason Skaarup

(74) *Attorney, Agent, or Firm* — Kevin L. Daffer; Daffer McDaniel, LLP

(57) ABSTRACT

An arm-wrestling robot is disclosed, comprising basically an arm-force generation mechanism 10 and a control system 100 that detects the maximum arm-force of a user in the early stage of the match, generates a different game scenario each time, and executes force feedback control to implement the scenario.

13 Claims, 24 Drawing Sheets

| TRIAL NO. | MAX. ARM-FORCE | TRIAL NO. | MAX. ARM-FORCE |
|---|---|---|---|
| 1 | 56.7 Nm | 5 | 63.0 Nm |
| 2 | 56.7 Nm | 6 | 51.7 Nm |
| 3 | 62.8 Nm | 7 | 60.8 Nm |
| 4 | 50.8 Nm | 8 | 53.8 Nm |

FIG.10b

| NO. | SUB-SCENARIOS (DEGREE, °) |
|---|---|
| 1 | ROTATE 10° MORE |
| 2 | ROTATE 20° MORE |
| 3 | ROTATE 30° MORE |
| 4 | ROTATE 40° MORE |
| 5 | ROTATE 50° MORE |
| 6 | ROTATE 60° MORE |
| 7 | ROTATE 70° MORE |
| 8 | ROTATE 80° MORE |
| 9 | ROTATE 90° MORE |
| 10 | ROTATE 100° MORE |
| 11 | ROTATE 110° MORE |
| 12 | ROTATE 120° MORE |
| 13 | ROTATE 130° MORE |
| 14 | ROTATE 140° MORE |
| 15 | ROTATE 150° MORE |
| 16 | ROTATE -10° MORE |
| 17 | ROTATE -20° MORE |
| 18 | ROTATE -30° MORE |
| 19 | ROTATE -40° MORE |
| 20 | ROTATE -50° MORE |
| 21 | ROTATE -60° MORE |
| 22 | ROTATE -70° MORE |
| 23 | ROTATE -80° MORE |
| 24 | ROTATE -90° MORE |
| 25 | ROTATE -100° MORE |
| 26 | ROTATE -110° MORE |
| 27 | ROTATE -120° MORE |
| 28 | ROTATE -130° MORE |
| 29 | ROTATE -140° MORE |
| 30 | ROTATE -150° MORE |

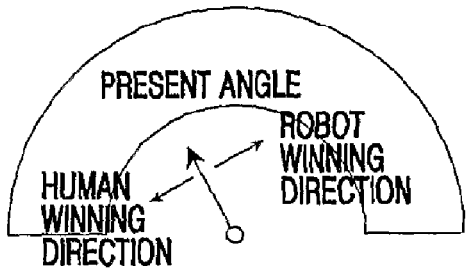

NO. 8~15:WINNING SUB-SCENARIOS
NO. 1~7, 16~23:DRAWING SUB-SCENARIOS
NO. 24~30:LOSING SUB-SCENARIOS

| WILL POINT | USER-WINNING PROBABILITY | DRAWING PROBABILITY | USER-LOSING PROBABILITY |
|---|---|---|---|
| 90-100 | 10% | 90% | 0% |
| 80-90 | 8% | 90% | 2% |
| 70-80 | 6% | 90% | 4% |
| 60-70 | 4% | 90% | 6% |
| 50-60 | 2% | 90% | 8% |
| 0-50 | 0% | 90% | 10% |

FIG. 16a

| TRIALS | ELAPSED TIME(s) | WIN/ LOSE | TRIALS | ELAPSED TIME(s) | WIN/ LOSE |
|---|---|---|---|---|---|
| 1 | 11.0 | WIN | 14 | 17.6 | LOSE |
| 2 | 14.0 | WIN | 15 | 14.5 | LOSE |
| 3 | 20.0 | WIN | 16 | 7.8 | LOSE |
| 4 | 47.0 | LOSE | 17 | 12.0 | LOSE |
| 5 | 20.0 | WIN | 18 | 11.5 | WIN |
| 6 | 23.2 | WIN | 19 | 23.4 | WIN |
| 7 | 13.6 | WIN | 20 | 8.4 | LOSE |
| 8 | 11.7 | WIN | 21 | 14.7 | WIN |
| 9 | 14.5 | WIN | 22 | 6.4 | WIN |
| 10 | 22.2 | LOSE | 23 | 18.8 | LOSE |
| 11 | 12.1 | WIN | 24 | 15.1 | LOSE |
| 12 | 9.5 | WIN | 25 | 13.6 | WIN |
| 13 | 12.1 | LOSE | 26 | 19.5 | WIN |

FIG. 16b

| | AVERAGE ELAPSED TIME | PROBABILITY OF WIN |
|---|---|---|
| PERSON 1 | 17.0 SEC | 63% |
| PERSON 2 | 14.0 SEC | 75% |

ARM-WRESTLING ROBOT AND THE CONTROL METHOD

TECHNICAL FIELD

The present invention relates to a service robot or an entertainment robot, and, more particularly, an arm-wrestling robot simulating human's arm-wrestling.

BACKGROUND ART

Conventional arm-wrestling devices may be classified roughly into three types according to the means of providing reaction force against player's arm-force. First type is to make use of spring force, and a typical example of this one is U.S. Pat. No. 3,947,025, in which the arm-wrestling exercise device is comprised of a helical coiled spring that has adjustable stiffness as shown in FIG. 1*a*. Other examples of this type are U.S. Pat. Nos. 6,652,428; 5,458,554; 5,431,616; 4,900,019; 3,662,602; and Russia Patent No. 2,128,539. As a similar one with this type, there is China Patent 2691654, in which the system is weight-loaded.

The second type of arm-wrestling devices uses pneumatic or hydraulic cylinders, which is better than the previous spring type from the viewpoint of force manipulability, however disadvantages of this type are that the system becomes complicated and bulky because of the supplementary devices for pneumatic or hydraulic pressure generation, and so possibly becomes expensive. The typical inventions of this type are U.S. Pat. No. 5,842,958 as shown in FIG. 1*b* and U.S. Pat. No. 4,805,900 as shown in FIG. 1*c*. Some other inventions of this type are U.S. Pat. Nos. 3,400,793; 4,406,454; 4,754,964 and Japan Patent Publication No. 55-54969.

The third type of arm-wrestling devices uses electric motors instead of springs or pneumatic/hydraulic cylinders in order to generate resistive force against the user, and most of recent arm-wrestling devices are included in this type. The typical invention of this type is Japan Patent Publication No. 06-315544 as shown in FIG. 1*d*, in which a torque motor is used for generating arm force, and a sensor plate and a photosensor are used for detecting arm speed in order to prevent a throw fracture of a player. Another example of this type is Japan Patent Publication No. 54-161436.

However the foregoing devices are invented for playing simple arm-wrestling games or practicing strength training, in which they usually generate fixed force levels (that are selectable via buttons or other means). If a player generates a bigger force than the arm-wrestling device, then he will win, and, otherwise he will lose the game. Therefore, it has a deficiency that the player is soon bored with the arm-wrestling device after a few trials.

DISCLOSURE OF INVENTION

It is, therefore, a primary object of the present invention to provide an arm-wrestling robot and the control method that are not simple and are not easily bored, more specifically, that detect the maximum arm-force of a user in the early stage of the match, generate automatically and randomly a different arm-wrestling scenario each time in such a way that the user cannot predict a force pattern in advance, execute force feedback control to implement the scenario using feedback signals related to the motion of the mechanical arm and a feedback signal related to the torque acting on the mechanical arm, and thus are used together by the users with strong or weak arm-force without any adjustments via buttons or any other means.

It is another object of the present invention to provide the arm-wrestling robot and the control method that increase and maintain the enjoyment of arm-wrestling by the way that the user's will to win affects the winning probability of the match.

The characteristics and advantages of the present invention will become more apparent from the following detailed description of exemplary embodiments thereof, given in conjunction with the accompanying drawings.

BRIEF DESCRIPTION OF DRAWINGS

FIGS. 7-9*a* shows detailed flow charts about the control method.

FIG. 9*b* is a table showing maximum arm-forces measured from 8 youths in twenties.

FIG. 10*b* is an illustration showing winning, drawing, and losing sub-scenarios at a present arm angle of 10 degrees.

FIG. 16*a* is a table showing the elapsed time and winning/losing of each match when one user played arm-wrestling 26 times with the arm-wrestling robot of FIG. 14*a*.

FIG. 16*b* is a table summarizing results when two users played arm-wrestling 26 times each with the arm-wrestling robot of FIG. 14*a*.

DETAILED DESCRIPTION OF THE PREFERRED EMBODIMENTS

Figure 1A:
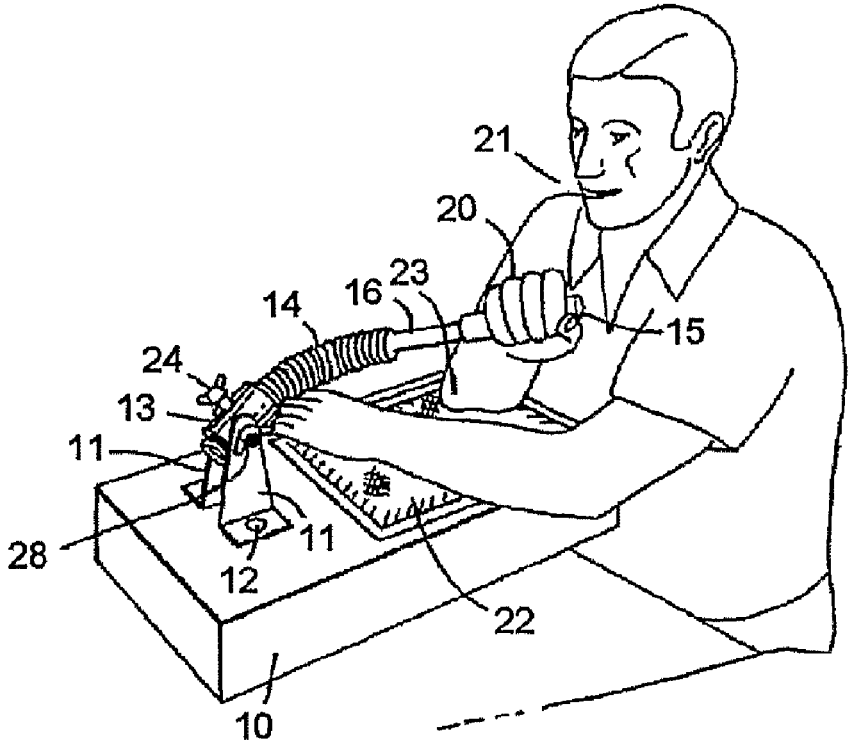
FIGS. 1*a*-1*d* are illustrations of typical arm-wrestling devices as used in the art.
Figure 1B:
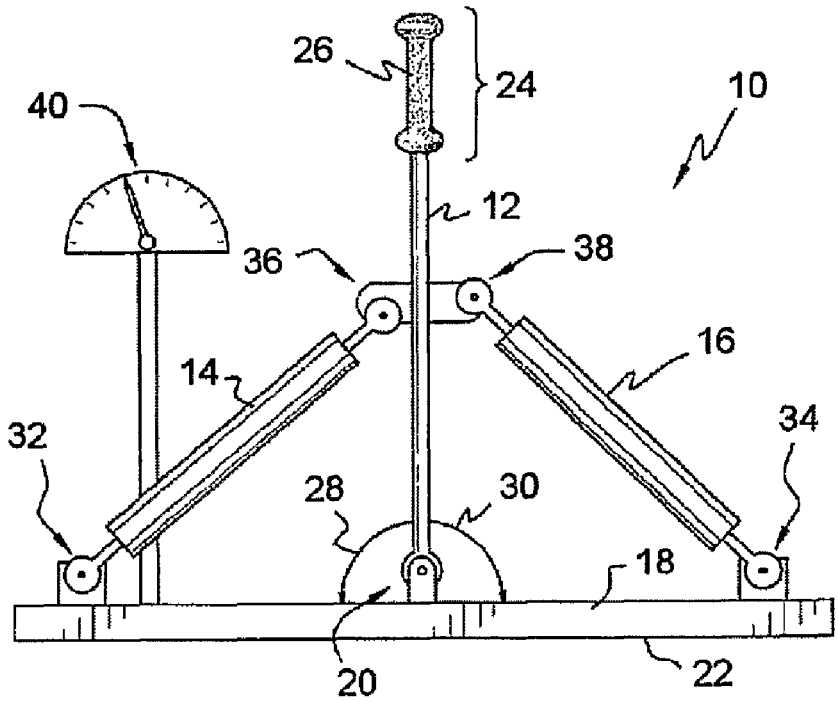
Figure 1C:
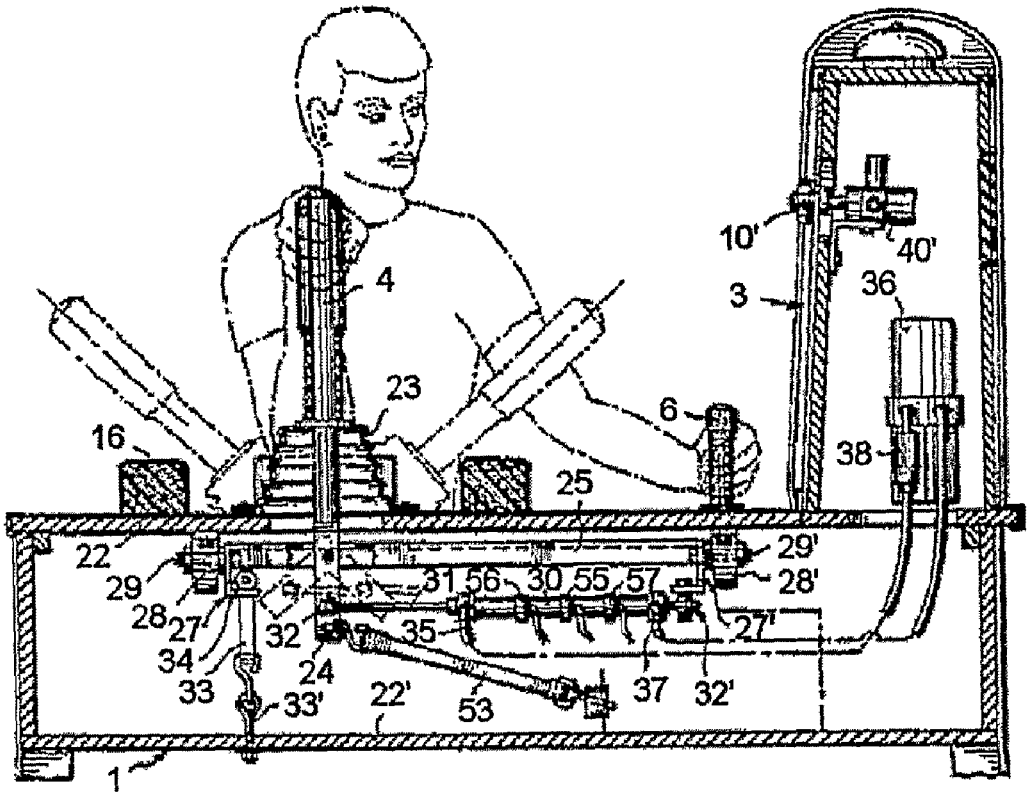

The present invention relates to an arm-wrestling robot comprising basically an arm-force generation mechanism 10 (numbers in the following indicate the ones in FIG. 2*a*, FIG. 2*b*, FIG. 2*c*, and FIG. 3) and a control system 100. The arm-force generation mechanism 10 includes basically an electric motor 11, a position/velocity sensor 12, a torque sensor 15 and a mechanical arm A. The control system 100 detects the maximum arm-force of the user in the early stage of the match, generates a different game scenario each time, and executes a force feedback control logic and produces motor control input signals to implement the scenario using feedback signals from the position/velocity sensor 12 related to the motion of the mechanical arm A and a feedback signal from the torque sensor 15 related to the torque acting on the mechanical arm A.

Figure 2A:
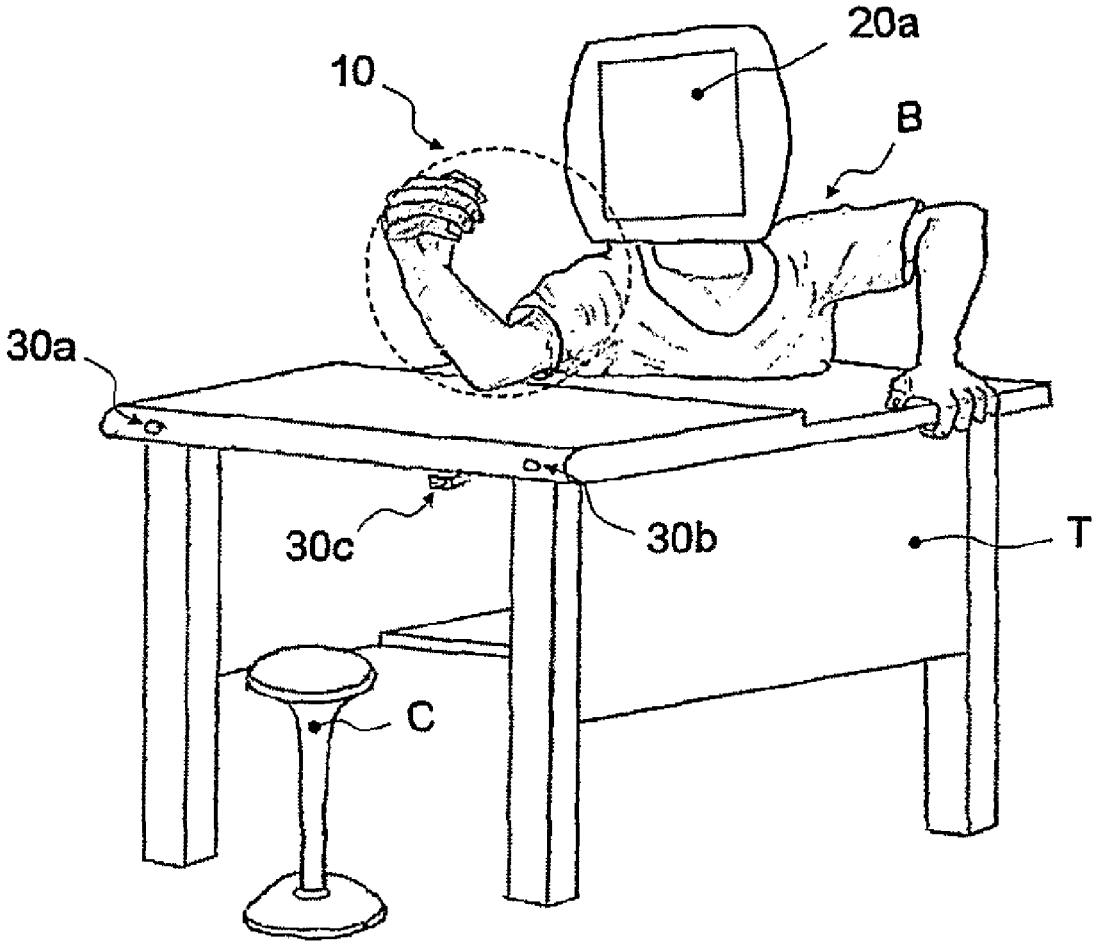
FIG. 2*a* is a perspective view of an arm-wrestling robot including an installing environment according to an embodiment of the present invention.

More specifically, FIG. 2*a* illustrates an arm-wrestling robot according to an embodiment of the present invention (referred to as 'the arm-wrestling robot' in the following) including an installing environment, in which a table T, a body B imitating the upper half of human body on the table T, an arm-force generation mechanism 10 being installed on the right-handed side (or, being installed on the left-handed side), an image output monitor 20*a* being attached on the body B and displaying guide messages for a user, a chair C in front of the table T, two ultrasonic sensors 30*a* and 30*b* on the front of the table T, and a photoelectric sensor 30*c* under the table T are shown. Although being not shown in FIG. 2*a*, the control system 100 under the table, voice output speakers 20*b* to guide the user are prepared.

Two ultrasonic sensors 30*a* and 30*b* (also one ultrasonic sensor or a plurality of ultrasonic sensors are possible) are attached at the right and the left sides on the front of the table T and detect human's approach within a prescribed range of angles near the arm-wrestling robot. Ultrasonic sensors have generally an advantage of high noise immunity compared to other types of sensors and can easily measure the distance of an approaching human under any circumstances. The photoelectric sensor 30*c* using infrared rays detects human's sitting on the chair C, which senses an object with a narrow angle range compared to other types of sensors.

In order to guide a player, the image output monitor 20*a* and/or voice output speakers 20*b* (in FIG. 3) are prepared, and voice output speakers may be integrated into the image output monitor 20*a* or may be installed separately at an appropriate position of the table T.

Figure 2B:
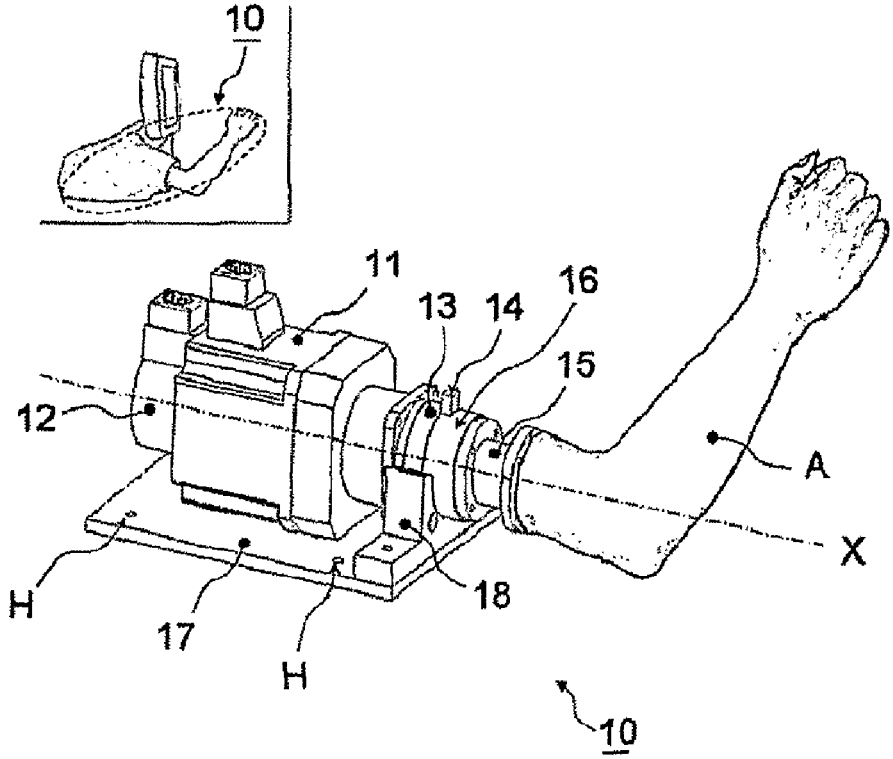
FIG. 2*b* is a perspective view of an arm-force generation mechanism according to an embodiment of the present invention.

The arm-force generation mechanism 10, more specifically as shown in FIG. 2*b*, comprises an electric motor 11 that provides necessary torque according to motor control input signals calculated from the control system 100, a position/velocity sensor 12 that detects angular position and angular velocity of the motor 11, and provides feedback signals related to angular motion for the control system 100, a speed reducer 13 that is connected to the motor 11, decreases the speed and increases the torque of the motor 11, a mechanical arm with hand A that the user grasps to play arm-wrestling, a torque sensor 15 that is installed between the speed reducer 13 and the mechanical arm A, and detects the torque acting on the mechanical arm A, an adapter 16 with a mechanical stopper 14 that is installed between the speed reducer 13 and the mechanical arm A, and is utilized to restrict the angle range of motion of the mechanical arm A in order to guarantee safety of the user, and a bottom plate 17 that supports the motor 11 and a stopper seat block 18, and is itself fastened on the table T. The arm-force generation mechanism 10 makes the mechanical arm A to rotate in a clockwise or a counterclockwise direction using torque produced by the motor 11.

An incremental encoder is selected desirably as the position/velocity sensor 12 therein for high resolution (also, other type of the position/velocity sensor is possible), and a harmonic drive instead of conventional gears is selected desirably as the speed reducer 13 since conventional gears have large backlash and thus cause trouble in torque control performance.

Figure 2C:
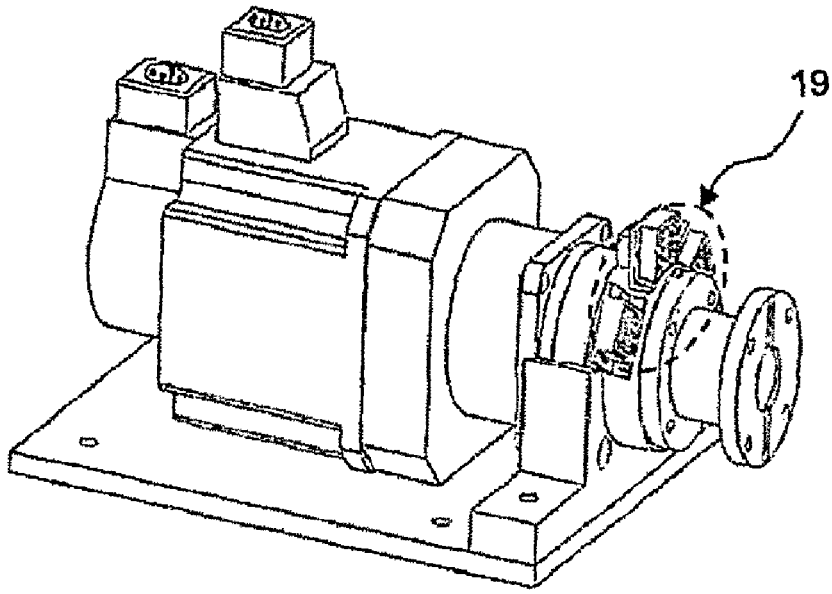
FIG. 2*c* is a perspective view showing inclinometers attached to an adaptor according to an embodiment of the present invention.

The adaptor 16 with the mechanical stopper 14 is further utilized to set an initial absolute angle of the mechanical arm A via low speed control of the motor 11. The detailed description on the initial setting of the absolute angle is given below. The initial setting of an absolute angle of the arm can also be achieved via using one, two or three inclinometers 19 as shown in FIG. 2*c*, instead of using the mechanical stopper 14.

The torque sensor 15 installed between the speed reducer 13 and the mechanical arm A should have reasonable resolution in order to get a reasonable force control performance.

The bottom plate 17 has a plurality of fixing holes H and plays a role to fix the arm-force generation mechanism 10 to the table T using bolts and nuts or using similar means. However, it is possible to fix the arm-force generation mechanism 10 to the table T directly without using the bottom plate 17.

Figure 3:
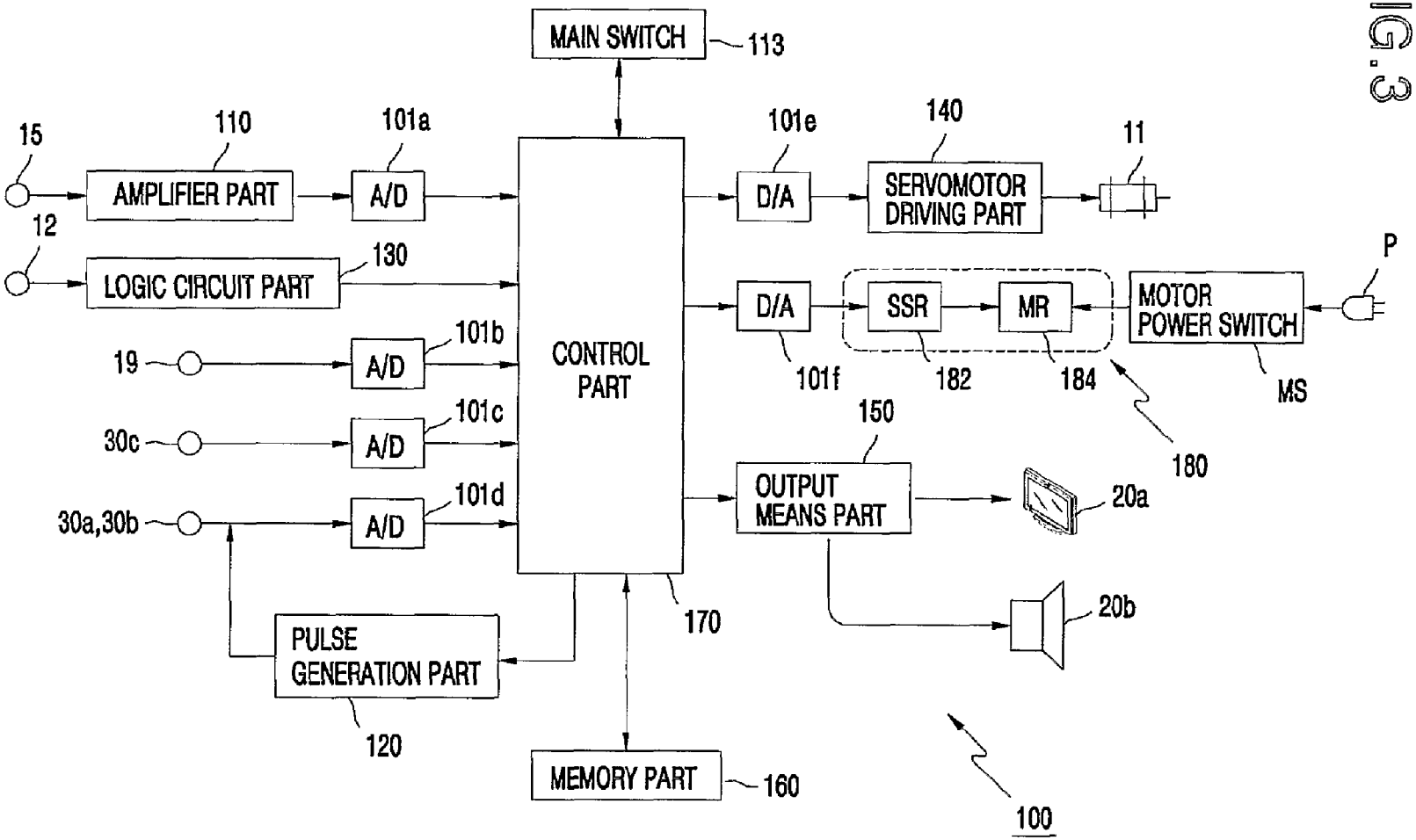
FIG. 3 is a block diagram of the control system according to an embodiment of the present invention.

FIG. 3 shows the control system 100 comprising an amplifier part 110 that amplifies the low level voltage signal coming from the torque sensor 15 and achieves signal conditioning, a logic circuit part 130 that conditions the feedback signal from the position/velocity sensor 12, a pulse generation part 120 that produces a pulse signal for the ultrasonic sensors 30*a* and 30*b*, a motor driving part 140 that drives the motor 11 according to motor control input signals, an output means part 150 that drives voice output speakers 20*b* and an image output monitor 20*a*, a memory part 160 that stores a control program 200 including control logic and scenarios, and a control part 170 that produces motor control input signals using the control program 200 and the feedback signals and transmits it to the motor driving part 140, and produces voice and image signals and transmits them to the output means part 150.

An A/D converter 101*a* is inserted between the amplifier part 110 and the control part 170 in order to convert analog voltage signals into digital signals that the control part 170 can recognize, and also A/D converters 101*b*-101*d* are similarly inserted between inclinometers 19 and the control part 170, ultrasonic sensors 30*a*-30*b* and the control part 170, and the photoelectric sensor 30*c* and the control part 170. Between the control part 170 and the motor driving part 140, a D/A converter 101*e* is inserted to transform digital signals into analog voltage signals.

As shown in FIG. 3, the control system 100 further comprises a motor power control part 180 including a solid state relay 182 that receives an initialization completion signal coming from the control part 170 and sends a corresponding output signal to a mechanical relay 184, the mechanical relay 184 that connects the power source P and the motor driving part 140 according to the output signal coming from the solid state relay 182, and a motor power switch MS on the power line, in order to apply the electric power P to the motor 11 only when the initialization procedure at the control part 170 is completed.

When the control part 170 is down due to some reasons, the D/A converter 101*e* may still output the last signal of the motor control input before the down condition, and thus a dangerous situation may occur if the electric power is applied again to the motor 11 at this condition.

In order to resolve this problem, the control part 170 transmits the initialization completion signal to the motor power control part 180 through a D/A converter 101*f* or a digital output pin, and sends 0 value to the motor driving part 140 through the D/A converter 101*e* when the initialization procedure at the control part 170 is completed (the initialization procedure starts when the main switch 113 is pressed). Then the motor power control part 180 turns on the mechanical relay 184 to supply the electric power P to the motor 11 according to the output signal of the sold state relay 182 that is in turn actuated by the initialization completion signal.

Therefore user safety is guaranteed even if the motor power switch MS is turned on before completing the initialization procedure or at abnormal conditions of the control system 170 since the electric power is not transmitted to the motor 11.

The control system 100 controls force and motion of the mechanical arm A using force feedback control logic, in which torque command is generated according to sub-scenarios. As soon as execution of a sub-scenario is completed, the next sub-scenario is immediately prepared that has random characteristics in force increment and force duration. This sub-scenario may be generated on-line at that instant or may be selected among many sub-scenarios prepared in advance. A scenario of the arm-wrestling is composed of these several sub-scenarios. The detailed description on the scenario is given below.

Figure 4A:
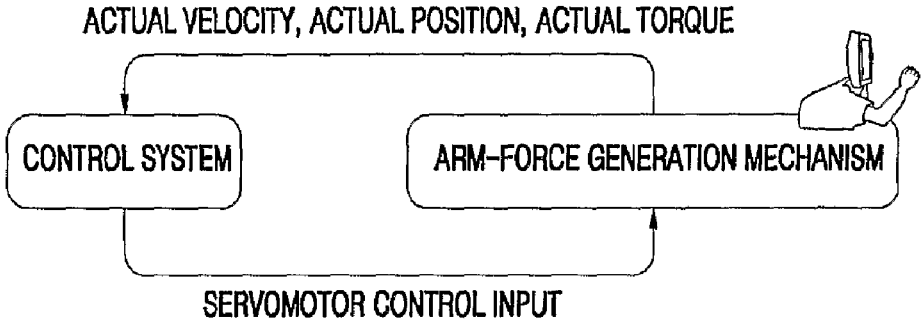
FIG. 4*a* is a schematic view showing the basic operational principle of the arm-wrestling robot according to an embodiment of the present invention.
Figure 4B:
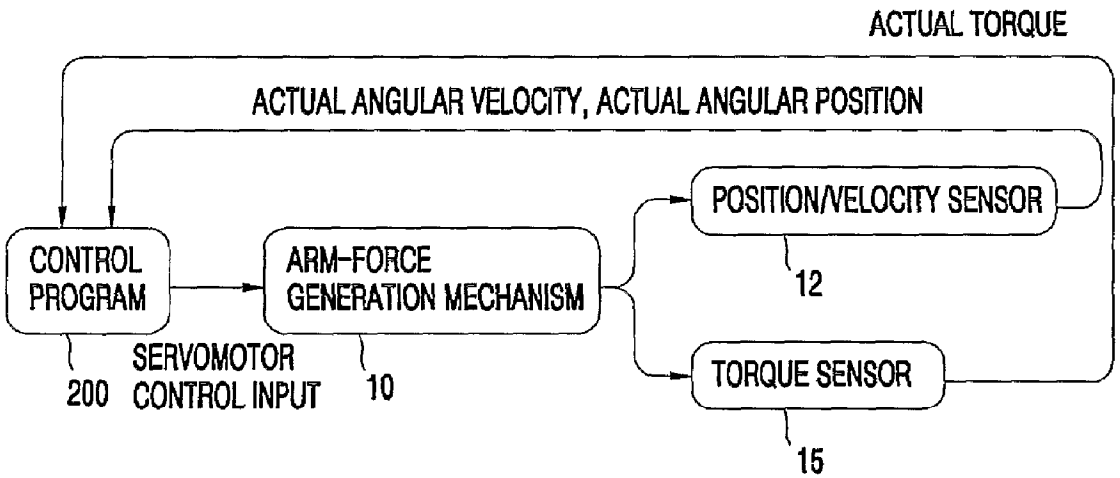
FIG. 4*b* is a schematic view showing the principle of force feedback control including the control program according to an embodiment of the present invention.

The basic operational principle of the arm-wrestling robot is shown in FIG. 4*a*, and, more specifically, in FIG. 4*b*. That is, the control system 100 receives feedback signals of actual angular position and velocity from the position/velocity sensor 12 and of actual torque from the torque sensor 15, calculates torque command using feedback signals and scenarios, and controls the mechanical arm A via generating the motor control input signal using force feedback control logic.

Figure 5A:
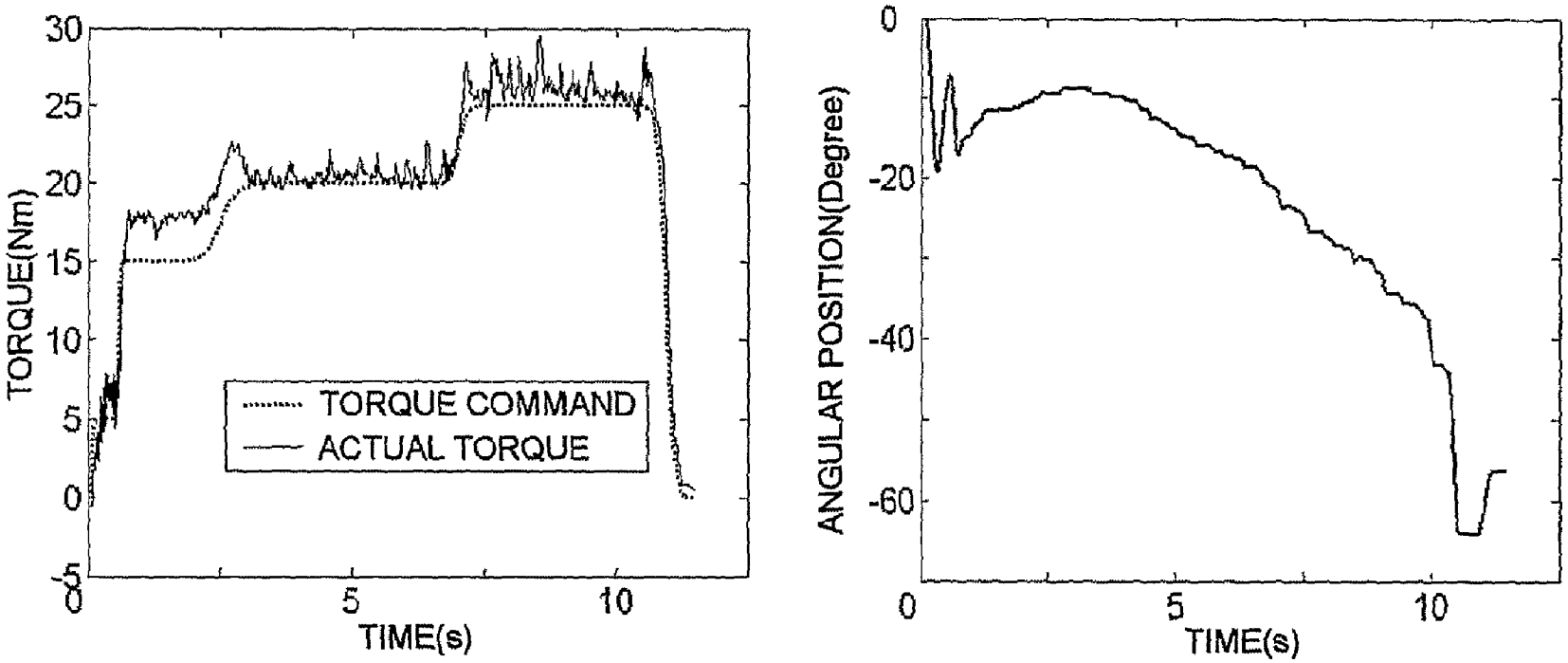
FIG. 5*a* shows exemplary graphs about torque commands and actual torques according to an embodiment of the present invention.

Force control performance is mainly dependent on the accuracy of feedback signals from the sensors, real-time control capability including the accuracy of sampling time, and the force feedback control logic itself. FIG. 5*a* shows exemplary graphs about torque commands (dotted lines) and actual torques (solid lines) when a user arm-wrestles against the arm-wrestling robot. In FIG. 5*a*, abscissas represent time [sec] and ordinates represent torque [N·m].

Figure 5B:
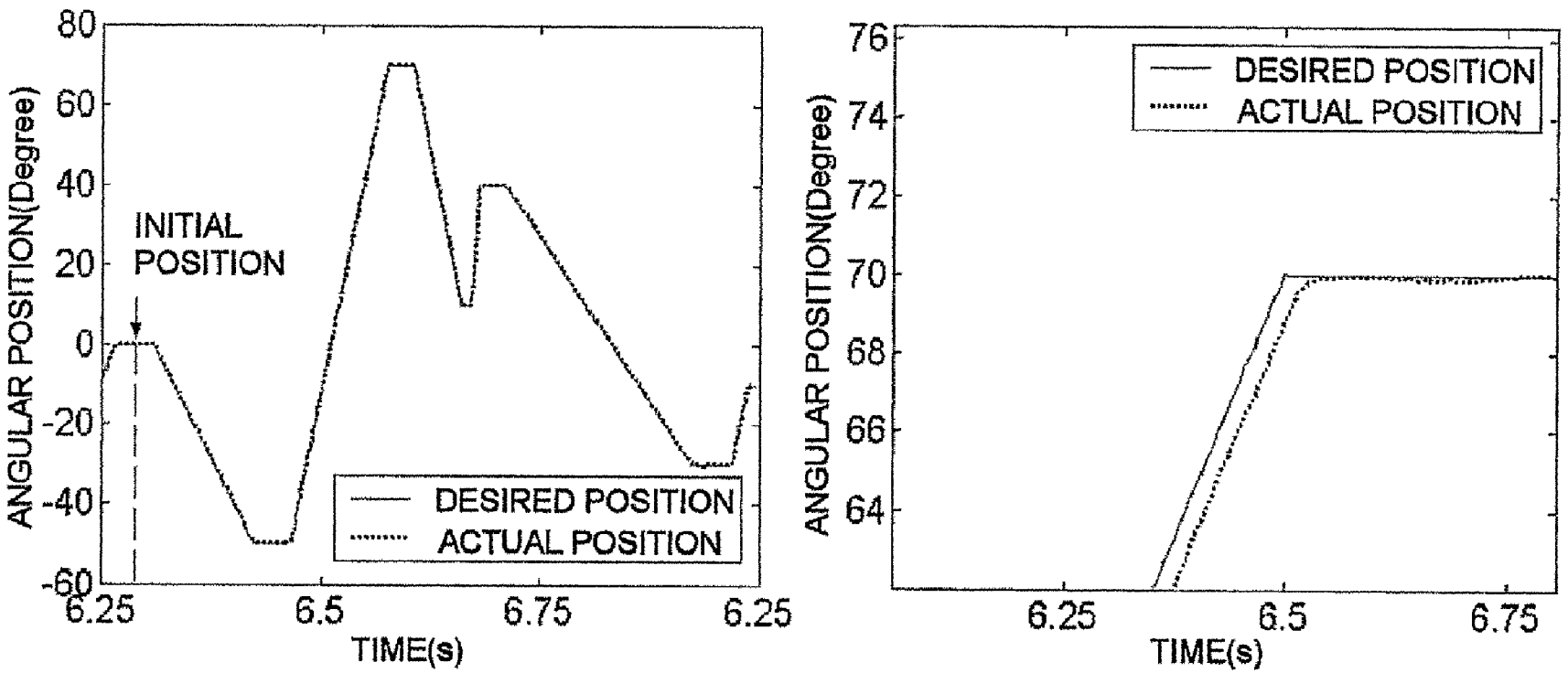
FIG. 5*b* shows exemplary graphs about desired positions and actual positions via position feedback control according to an embodiment of the present invention.

Force feedback control plays a key role in arm-wrestling of the arm-wrestling robot, but position feedback control is also necessary for rotating the mechanical arm A to a starting position and setting the initial absolute angle of the mechanical arm A. FIG. 5*b* shows exemplary graphs about a result of position feedback control of the arm-wrestling robot. In FIG. 5*b*, desired positions are represented by solid lines and actual positions are represented by dotted lines. Right side graph in FIG. 5*b* is an enlarged one of the left side graph around 6.5 sec.

When using the incremental encoder as the position/velocity sensor 12, we need to set initially absolute zero degree of the mechanical arm A. This initial setting of the arm angle is accomplished using the mechanical stopper 14 and velocity feedback control. More specifically, the control part 170 drives slowly the motor 11 clockwise or counterclockwise using position feedback control, and measures torque value of the torque sensor 15. If the measured torque is bigger than the specified value, then the control part 170 set the present angular position as the specified degree of absolute angle since the big measured torque implies that the mechanical stopper 14 hit the stopper seat block 18.

Initial setting of an absolute arm angle also can be accomplished using further elements, a plurality of inclinometers 19, without using the mechanical stopper 14, but in this case the arm-force generation mechanism 10 becomes more complicated and possibly more expensive.

Figure 6:
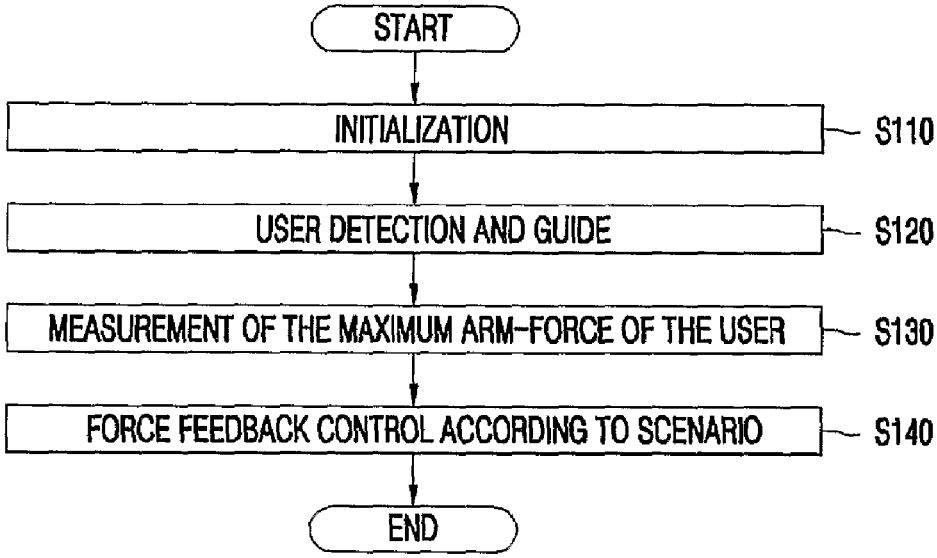
FIG. 6 shows a flow chart about a control method of the arm-wrestling robot according to an embodiment of the present invention.

In the following, the method to control the arm-wrestling robot is described. As shown in FIG. 6, the method comprises basically three steps. In step 1 (S110), the arm-force generation mechanism 10 and the control system 100 are initialized and the setting of an initial angle of the mechanical arm A is achieved. In step 2 (S130), the maximum arm-force of the user is measured during a specified time interval based on the feedback signal coming from the torque sensor 15. In step 3 (S140), the arm-force generation mechanism 10 is actuated by force feedback control to execute an arm-wrestling scenario.

The method is also possible to further comprise one more step S120 between step 1 (S110) and step 2 (S130), in which human's approach to the arm-wrestling robot is detected using a plurality of ultrasonic sensors 30*a*-30*b* and human's sitting on the chair C is detected using a photoelectric sensor 30*c*.

Figure 7:
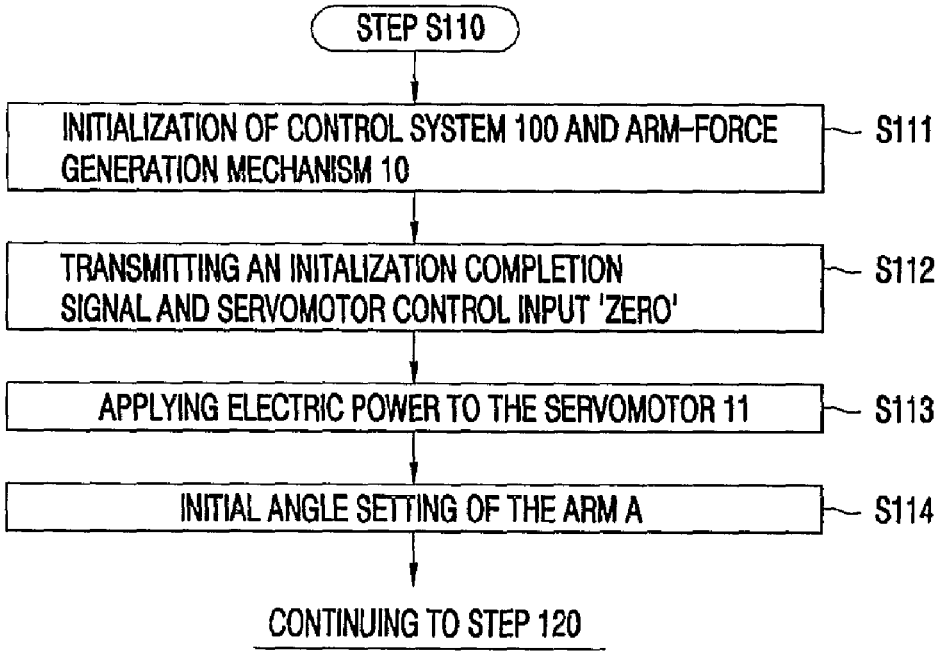

Step 1 (S110), as shown in FIG. 7, includes stage 1-1(S111) initializing the arm-force generation mechanism 10 and the control system 100, stage 1-2(S112) transmitting an initialization completion signal to the motor power control part 180 and transmitting the motor control input signal according to the torque command 'zero' to the motor driving part 140, stage 1-3(S113) applying a power source P to the motor driving part 140 after the motor power control part 180 receives the initialization completion signal, and stage 1-4 (S114) setting an initial absolute angle of the mechanical arm A.

Figure 8:
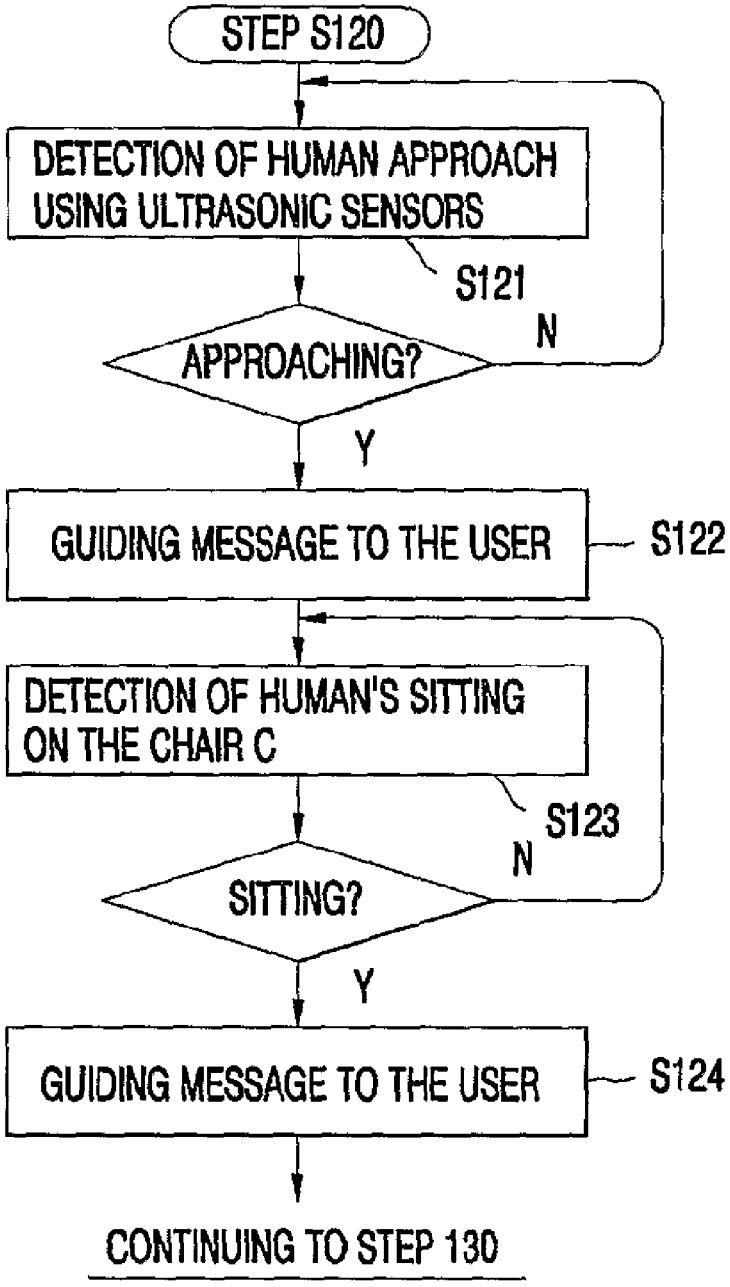

Step S120, as shown in FIG. 8, includes a stage S121 detecting human's approach near the arm-wrestling robot through ultrasonic sensors 30*a* and 30*b*, a stage S122 guiding the human with voice and image messages if the human is detected and repeating the stage S121 if not detected, a stage S123 detecting the human's sitting on the chair C, and a stage S124 guiding the human with voice and image messages if the human sits on the chair C and repeating the stage S123 if not.

In stages S122 and S124, guiding voice messages may be "Hello, welcome to the arm-wrestling robot! If you want to try arm-wrestling, please sit down on the chair.", "When you are ready, please grasp my hand to start.", and so forth. Image messages may be an avatar with varying facial expressions and/or text displays appropriate to arm-wrestling situations. Detailed guiding messages are omitted here because these messages are a supplementary function of the arm-wrestling robot and may vary without departing from the scope of the invention.

Figures 9A, 9B:
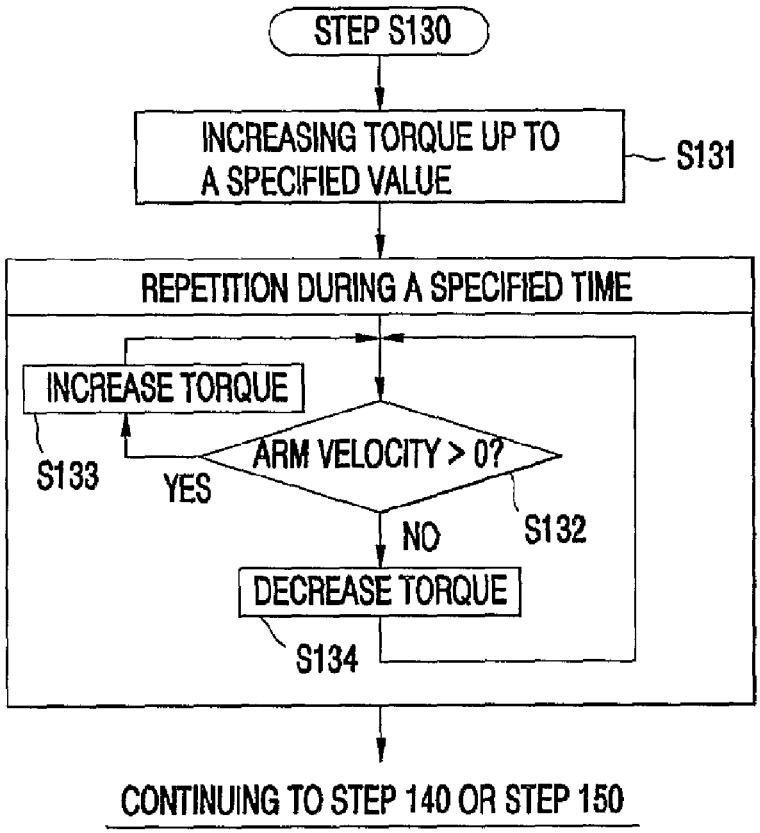

Step 2 (S130), as shown in FIG. 9*a*, includes stage 2-1 (S131) increasing the torque acting on the mechanical arm A up to a specified value, stage 2-2(S132) determining whether the velocity of the mechanical arm A is positive or not, stage 2-3(S133) increasing the torque acting on the mechanical arm A with a specific rule if the velocity is positive, stage 2-4 (S134) decreasing the torque acting on the mechanical arm A with a specific rule if the velocity is negative, and stage 2-5 repeating stage 2-2(S132) through stage 2-4(S134) during a specified time interval and determining the user's maximum arm-force.

FIG. 9*b* shows an exemplary table showing maximum arm-forces measured from 8 youths in twenties using the procedure in the step 2 (S130). In this table, the first and the third columns represent trial numbers, and the second and the fourth columns represent maximum arm-forces measured in N·m.

Figure 10A:
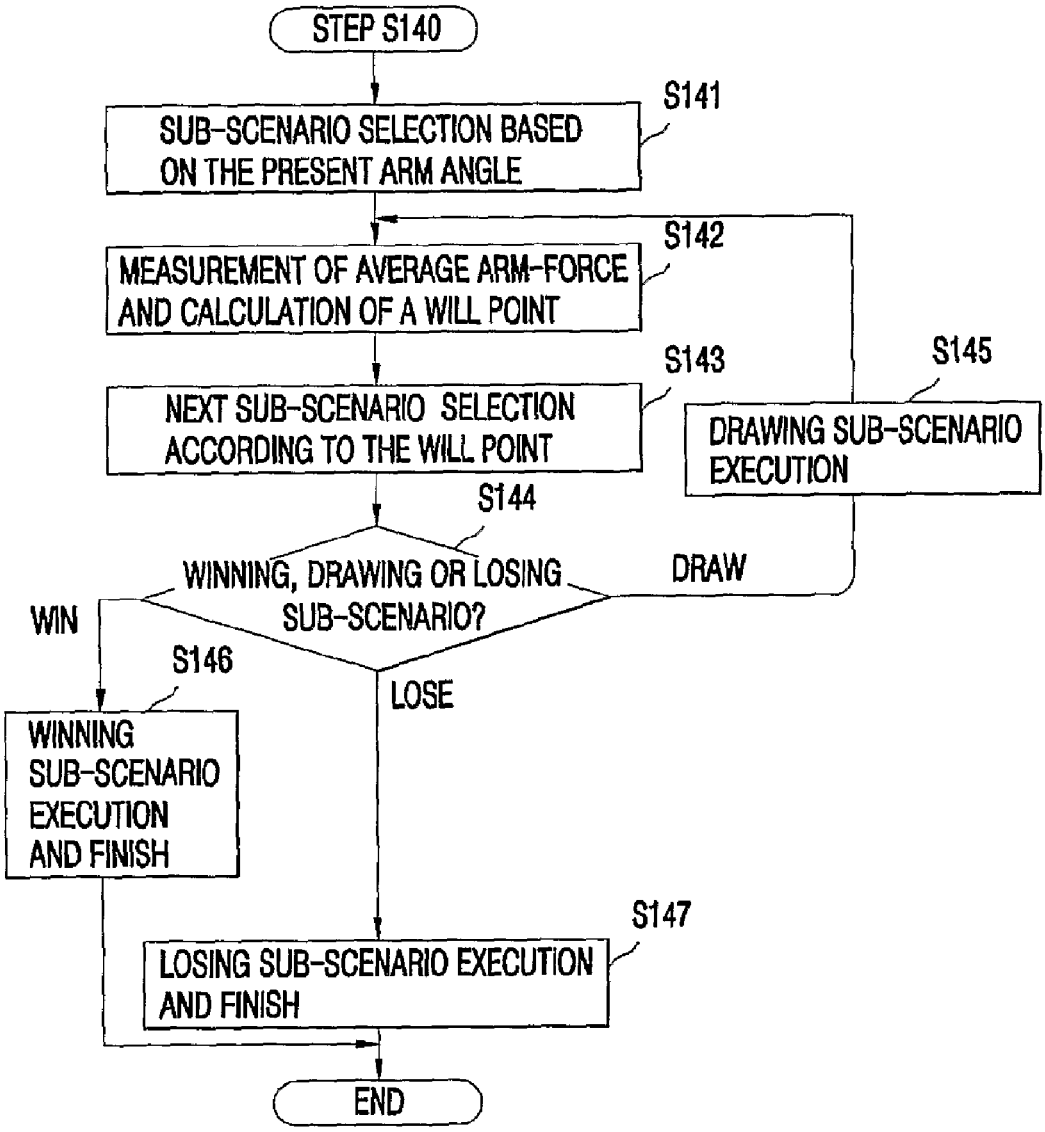
FIG. 10*a* and FIG. 10*e* show detailed flow charts about the control method of the arm-wrestling robot.

Step 3 (S140), as shown in FIG. 10*a*, includes stage 3-1 (S141) selecting at first one sub-scenario among winning, drawing, and losing sub-scenarios, stage 3-2(S142) calculating the will point of the user using the average arm-force measured by the torque sensor 15 during the execution of the selected sub-scenario and the maximum arm-force of the user measured at the step 2(S130), stage 3-3(S143) selecting the next sub-scenario among many sub-scenarios according to the will point calculated at stage 3-2(S142), stage 3-4(S144) deciding that the selected sub-scenario belongs to which one among winning, drawing, and losing sub-scenarios; stage 3-5(S145) returning to stage 3-2(S142) after completing force feedback control corresponding to the drawing sub-scenario if the selected sub-scenario is the drawing one, stage 3-6(S146) ending the match after completing force feedback control corresponding to the winning sub-scenario if the selected sub-scenario is the winning one, and stage 3-7(S147) ending the match after completing force feedback control corresponding to the losing sub-scenario if the selected sub-scenario is the losing one.

As to terminology, one match is accomplished using several sub-scenarios, and an arm-wrestling scenario (or just a scenario) consists of a set of several sub-scenarios.

A winning sub-scenario implies a significant decrease of torque command value, a losing sub-scenario implies a significant increase of torque command value, and a drawing sub-scenario implies a small increase, a small decrease, or no change of torque command value. The sub-scenarios are divided by predetermined intervals in advance, and however the grouping of winning, drawing and losing sub-scenarios is dependent on the present arm angle and is achieved using a prescribed rule. FIG. 10*b* shows exemplary sub-scenarios at the present arm angle of 10 degrees, in which each sub-scenario is divided into 10 degree intervals from −150 degrees to 150 degrees. For example, No. 8~15 in the table of FIG. 10*b* are classified as human winning sub-scenarios at the present arm angle.

At stage 3-2(S142), the will point is calculated using the following formula.

$$\text{will point}=(\text{average arm-force during one sub-scenario})/(\text{maximum arm-force of the user})\times 100$$

Figures 10C, 10D:
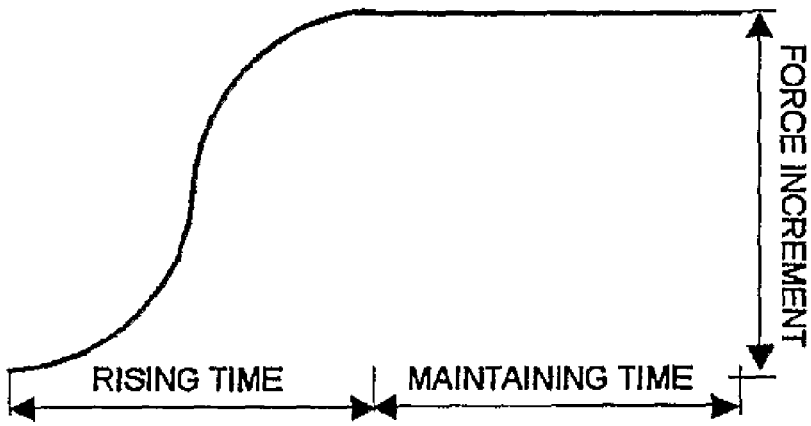
FIG. 10*c* is a table about exemplary will points and corresponding winning probabilities.
FIG. 10*d* shows a force pattern of a sub-scenario according to an embodiment of the present invention.

As the will point is nearer to 100, the user is considered to have stronger will to win the match. As the will point is nearer to 0, the user is considered to have weaker will to win the match. Arm-wrestling progression of the arm-wrestling robot is affected by this will point with exemplary probabilities as shown in FIG. 10*c*, in which the first column represents will point value, the second column represents human-winning probability, the third column drawing probability and the fourth column human-losing probability.

Figure 1D:
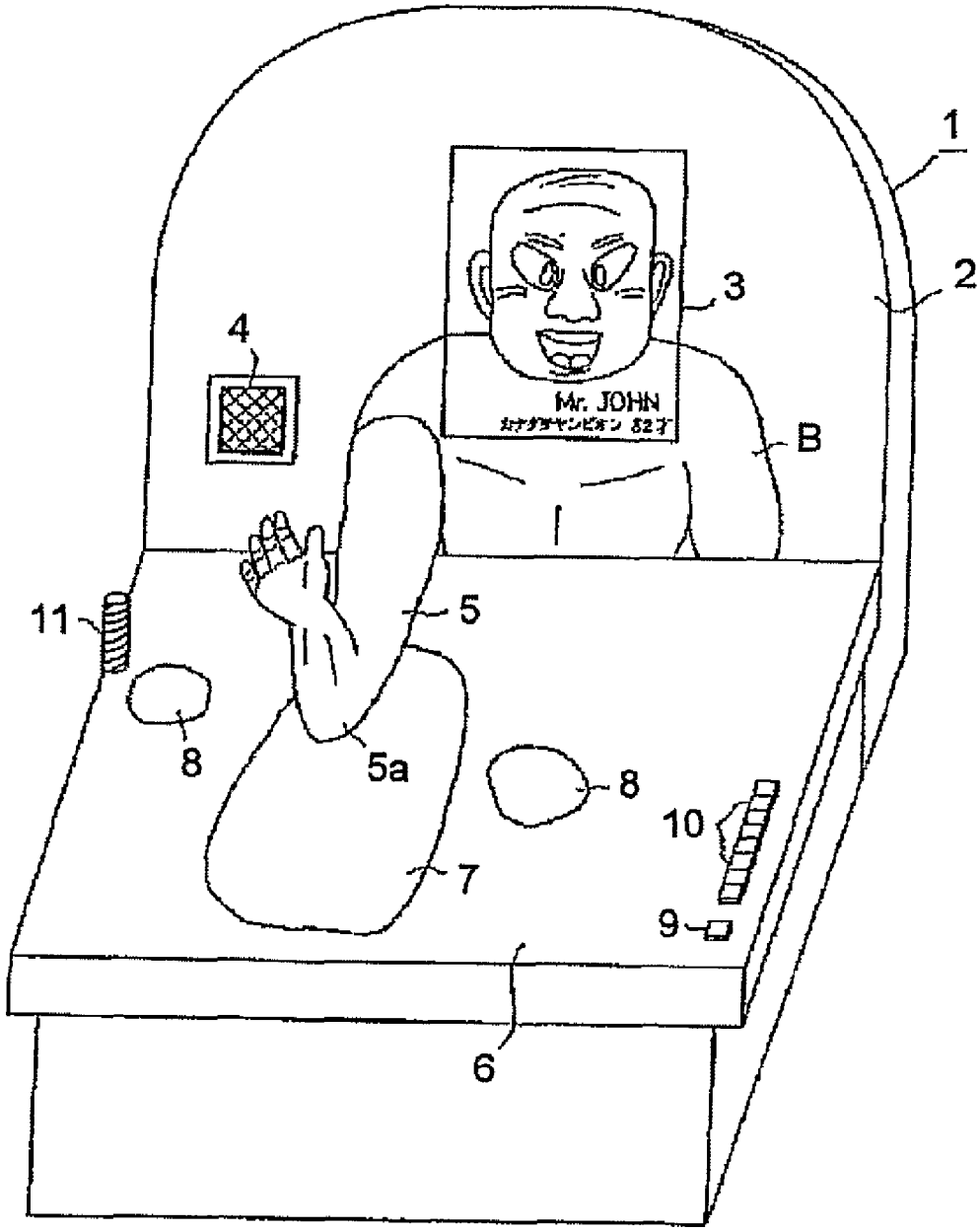

The step 3 can be implemented in a different way from the one in FIG. 10*a*. That is, the step 3 can be implemented via generating sub-scenarios on-line that are characterized by force increment, rising time, and maintaining time, as shown in FIG. 10*d*, that all three values are randomly determined. In FIG. 10*d*, the abscissa represents time and the ordinate represents torque level. The force increasing or decreasing in a sub-scenario is achieved by polynomial curves as shown in FIG. 1*d*, straight line, or other curves for smooth transition of robot arm-force.

Figure 10E:
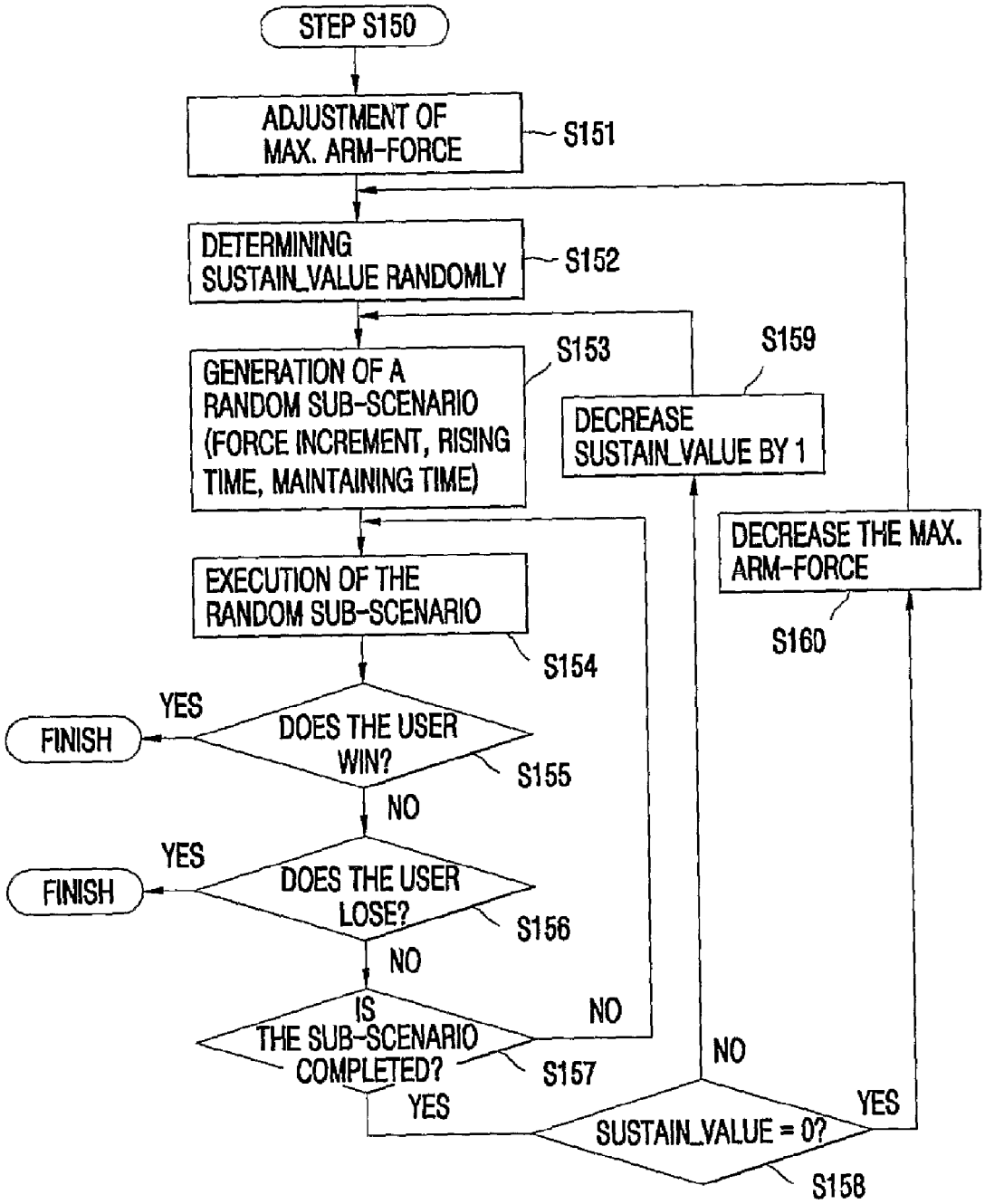

FIG. 10*e* shows another step 3, which includes stage 3-1 (S151) adjusting the maximum arm-force determined at the step 2(S130), stage 3-2(S152) determining the sustain_value randomly, stage 3-3(S153) generating a sub-scenario with random force increment, random rising time, and random maintaining time, stage 3-4(S154) executing the sub-scenario generated at the stage 3-3(S153), stage 3-5(S155) checking if the user wins and finishing the match if yes, stage 3-6(S156) checking if the user loses and finishing the match if yes, stage 3-7(S157) checking if the sub-scenario is completed and repeating stages 3-4(S154) to 3-7(S157) if no, stage 3-8 (S158) checking if the sustain_value equals zero, and going to stage 3-9(S159) if no, and going to stage 3-10 (S160) if yes, stage 3-9(S159) decreasing the sustain_value by 1 and going to stage 3-3(S153), and stage 3-10(S160) decreasing the maximum arm-force in a prescribed manner, and going to stage 3-2(S152).

In step 3(S150), the sustain_value variable is needed to make randomly the decreasing rate of average robot force as time passed.

Figure 11:
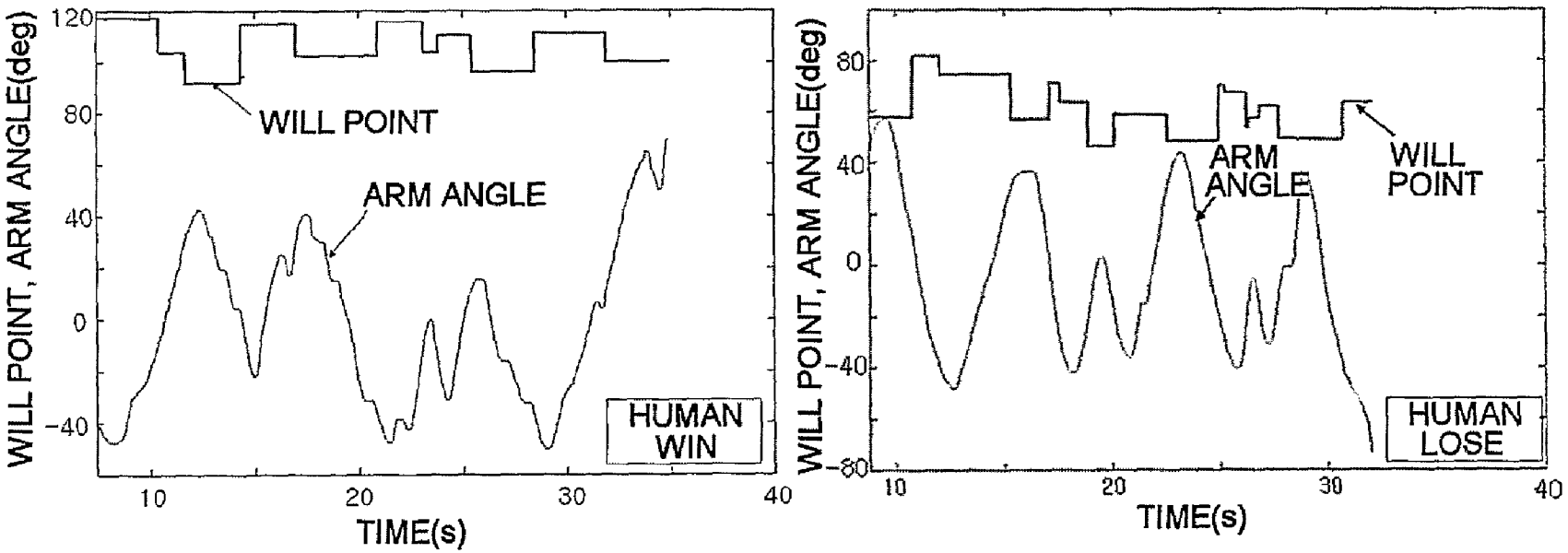
FIG. 11 shows exemplary graphs tested by two players with strong will and weak will to win the match.

FIG. 11 shows exemplary graphs (using step S140) tested by two players with strong will and weak will to win the match. In FIG. 11, upper solid lines represent will point of the user and lower solid lines represent arm angles in degrees. These figures show that will point is varying during a match and a strong will to win increases human's winning probability.

Figure 12:
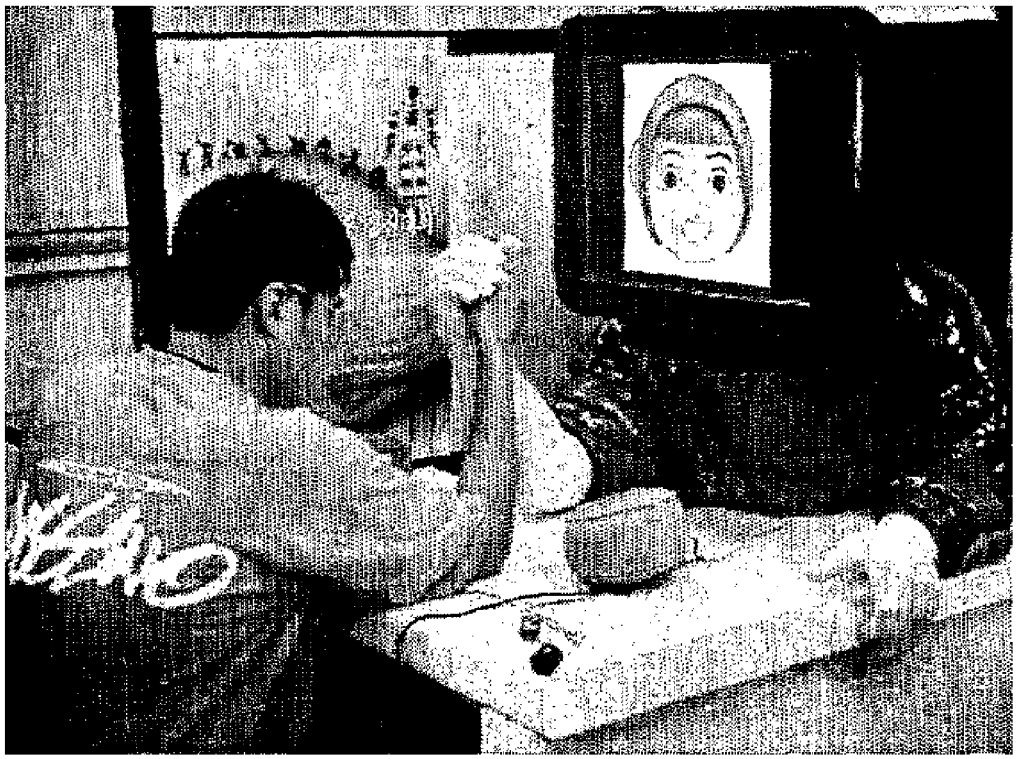
FIG. 12 is a picture showing a mode for carrying out the present invention, and a scene of an actual match between a user and the arm-wrestling robot.
Figure 13:
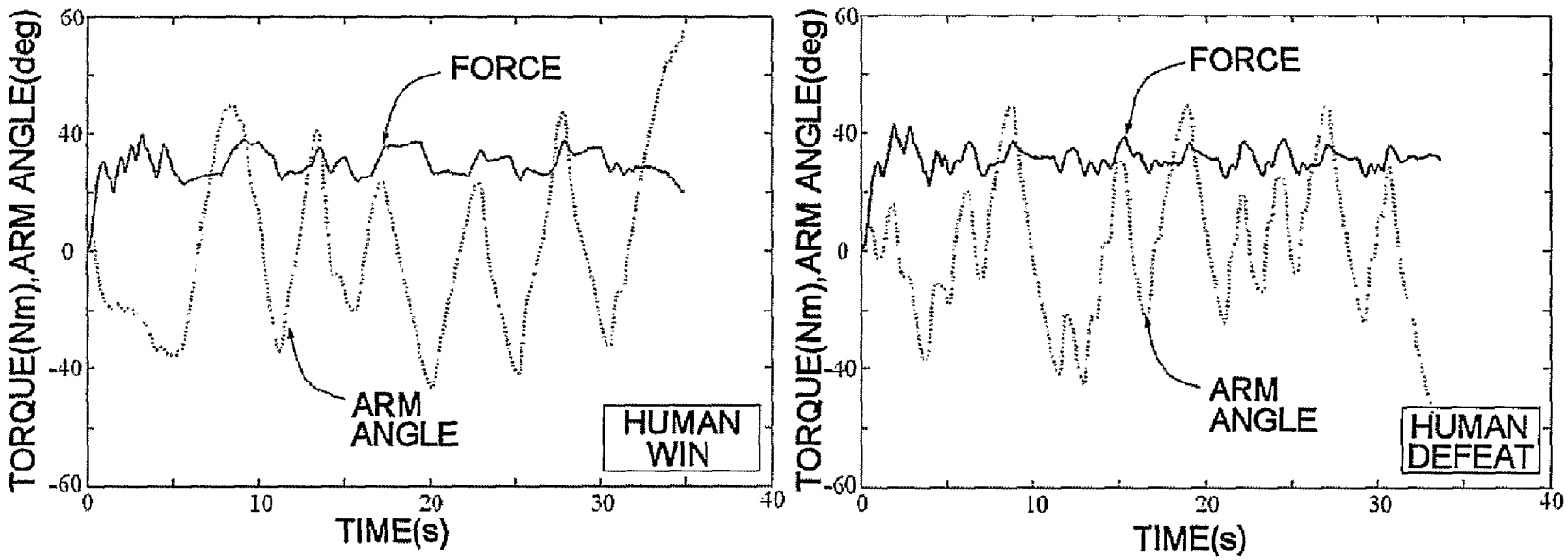
FIG. 13 is exemplary graphs tested two times by one user generating similar force patterns.

FIG. 12 is a picture showing a mode for carrying out the present invention, and a scene of an arm-wrestling between a user and the arm-wrestling robot. FIG. 13 is exemplary graphs (using step S140) tested two times with the arm-wrestling robot of FIG. 12 by one user generating similar force patterns. FIG. 13 shows that even if the user produces the same force patterns, the results of the match could be different. Graph (a) in FIG. 13 corresponds to the case the user wins, and graph (b) corresponds to the case the user loses. In these graphs (a) and (b), the upper solid lines represent will point of the user, and the lower solid lines represent arm angles in degrees.

Figure 14A:
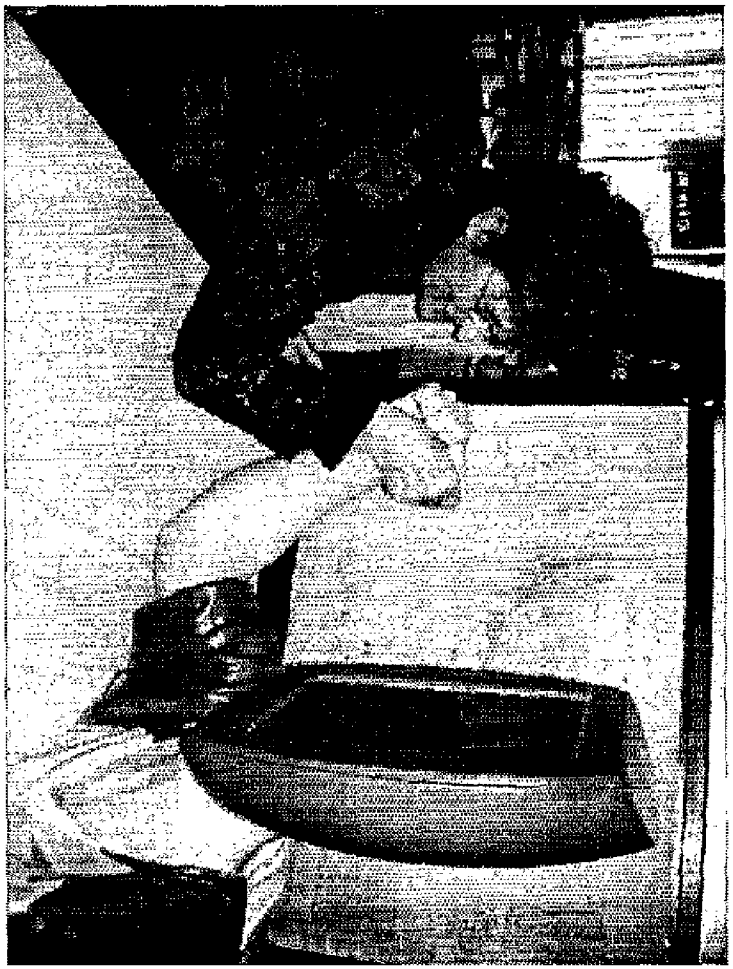
FIG. 14*a* is a picture showing another mode for carrying out the present invention and showing a woman 72 years old playing arm-wrestling.
Figure 14B:
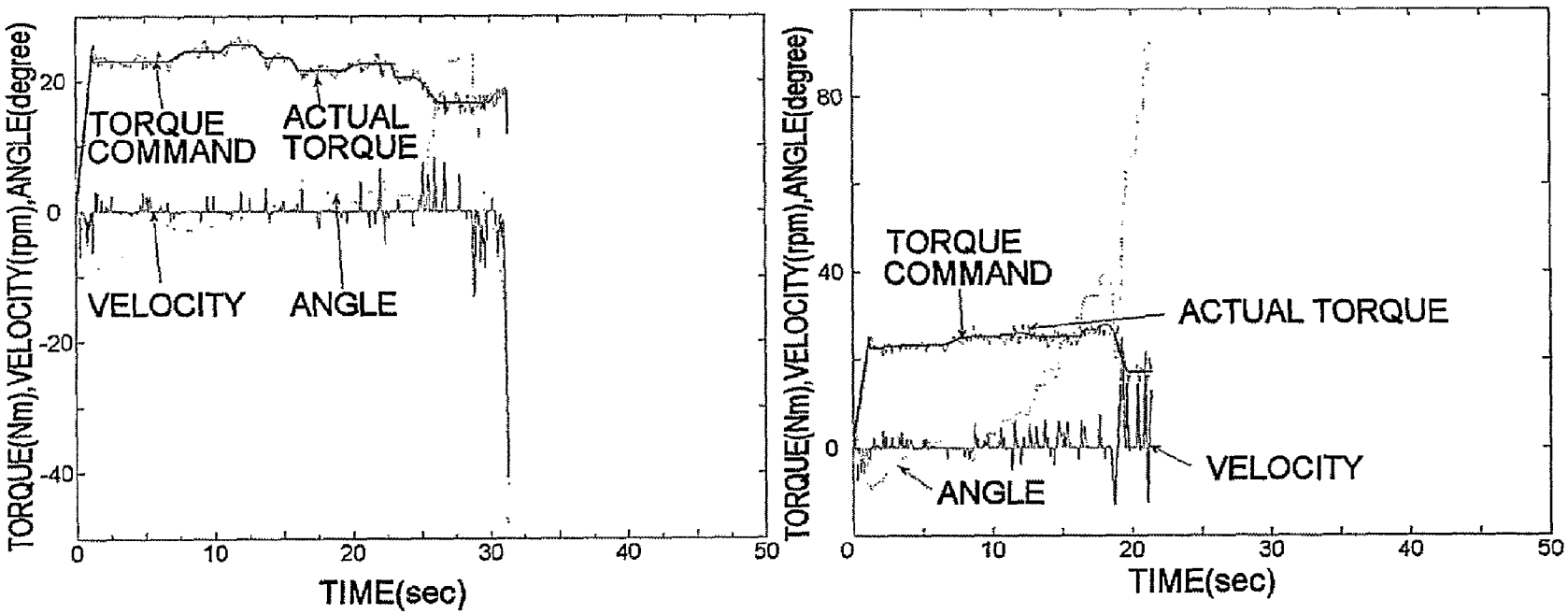
FIG. 14*b* is exemplary graphs showing arm-wrestling results of FIG. 14*a*.

FIG. 14*a* is a picture showing another mode for carrying out the present invention (using step S150) and a scene that a woman 72 years old played against the arm-wrestling robot. FIG. 14*b* is exemplary graphs showing match results of FIG. 14*a*. Graphs (a) and (b) in FIG. 14*b*, shows torque command (blue solid lines), actual torque (grey solid lines), angular velocity (red solid lines), and arm angles (grey dotted lines). Graph (a) corresponds to the case the old woman loses, and graph (b) corresponds to the case the old woman wins. From these graphs (a) and (b), we can see that force patterns generated by the arm-wrestling robot and the elapsed time of arm-wrestling are different from match to match even if the same person plays.

Figure 15A:
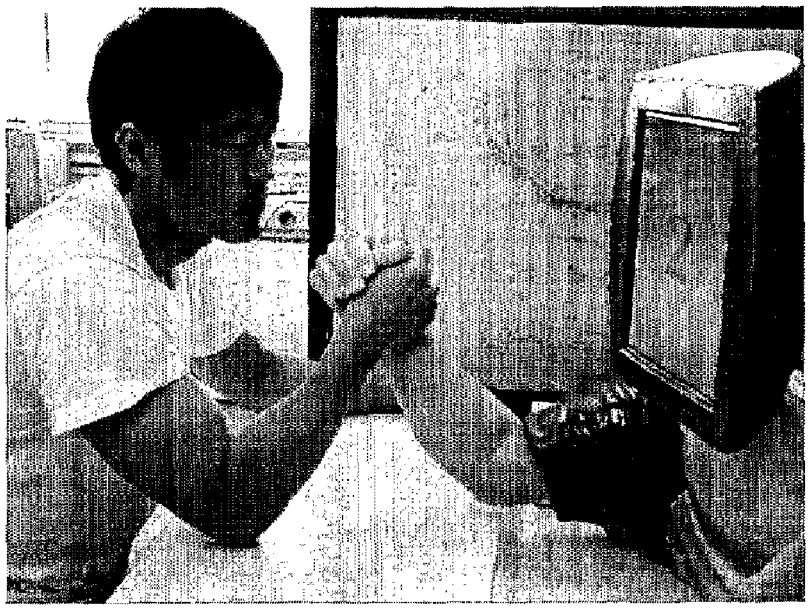
FIG. 15*a* illustrates a scene of a match between a youth 25 years old and the arm-wrestling robot in FIG. 14*a*, and a result of the match.
Figure 15A:
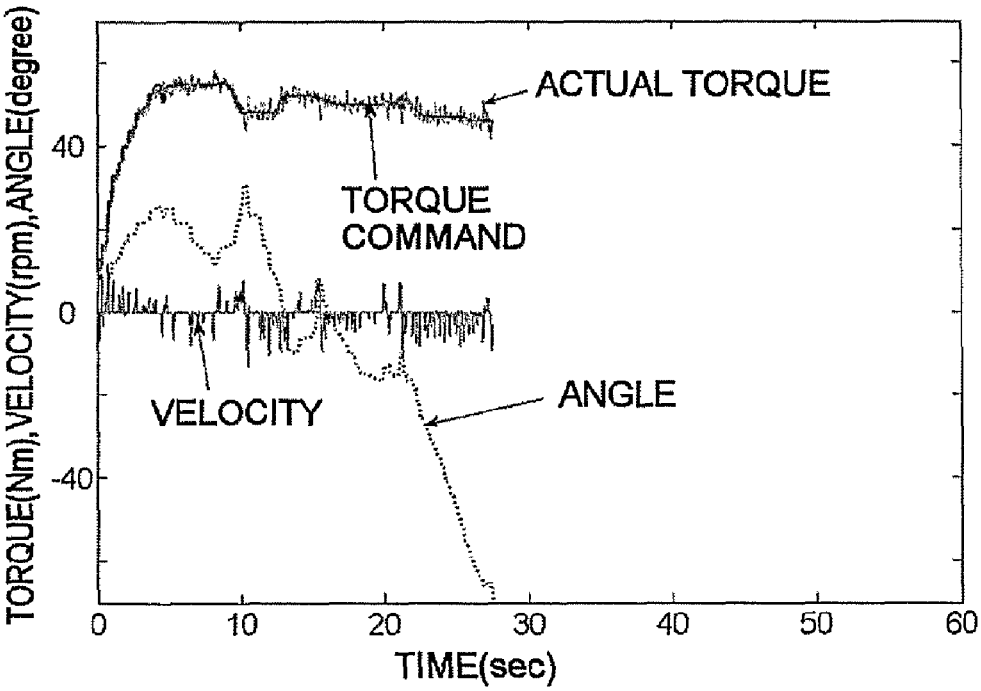
Figure 15B:
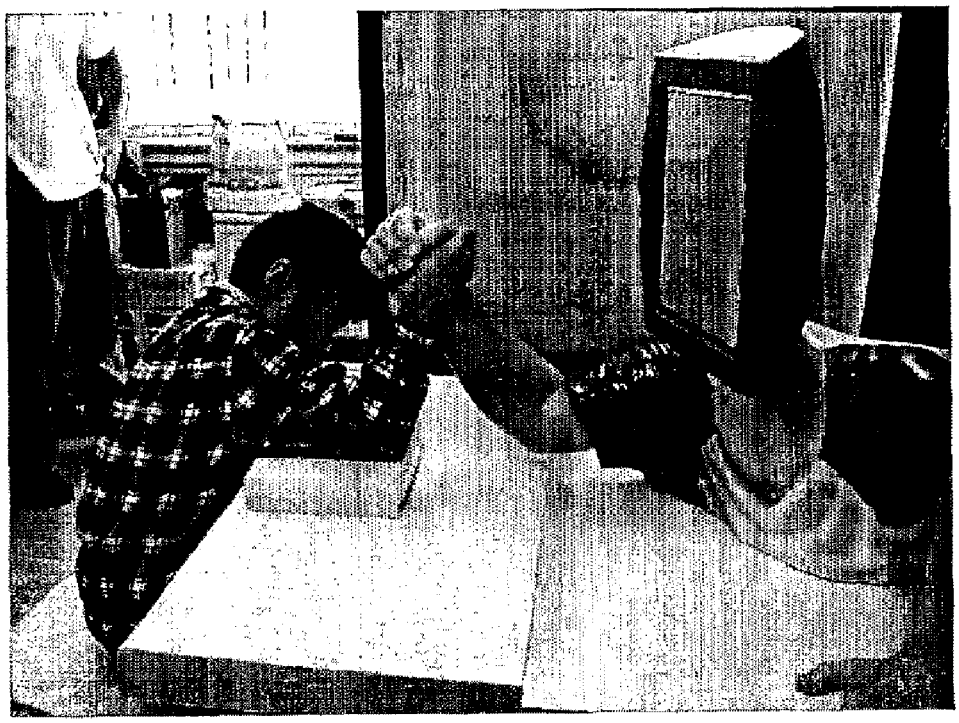
FIG. 15*b* illustrates a scene of a match between a child 10 years old and the arm-wrestling robot of FIG. 14*a*, and a result of the match.
Figure 15B:
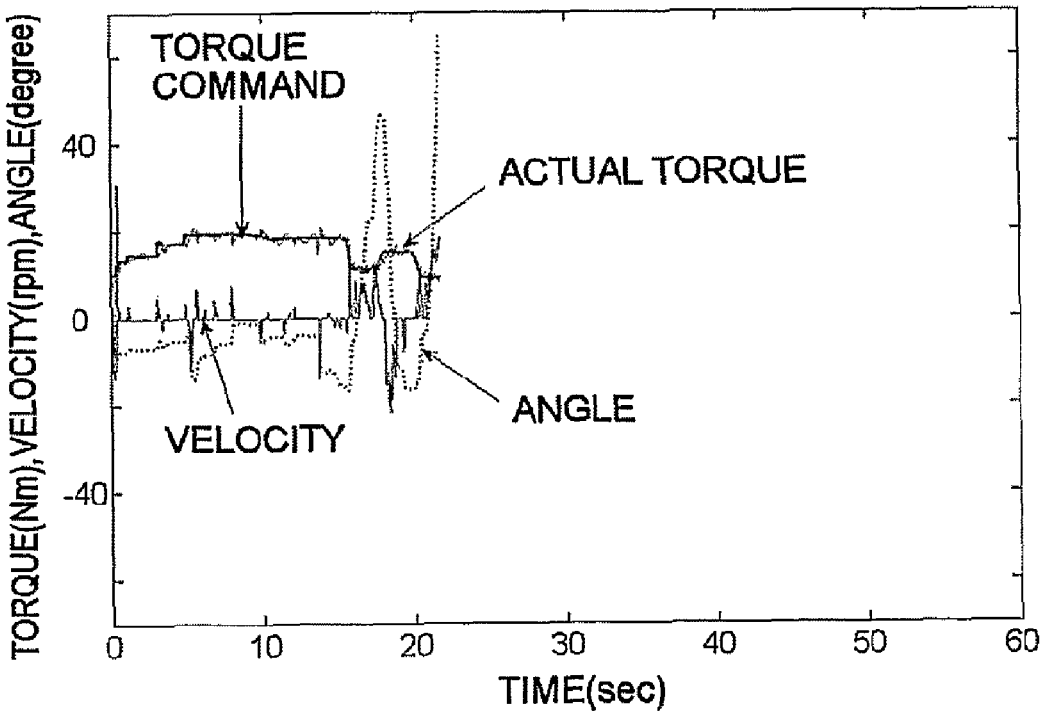

FIG. 15*a* illustrates a scene of a match between a youth 25 years old and the arm-wrestling robot in FIG. 14*a* and a result of the match. FIG. 15*b* illustrates a scene of a match between a child 10 years old and the arm-wrestling robot of FIG. 14*a* and a result of the match. As soon as the youth finished the match of FIG. 15*a*, the child started the match of FIG. 15*b*. Although the youth produced roughly 50 N·m and the child roughly 20 N·m, the arm-wrestlings were proceeded smoothly without changing anything of the arm-wrestling robot. In other words, the arm-wrestling robot of the present invention has a function to generate an appropriate force level automatically according to the magnitude of the user's arm-force.

FIG. 16*a* is a table showing the elapsed time and winning/losing of each match when one user played arm-wrestling 26 times with the arm-wrestling robot of FIG. 14*a*. From the table in FIG. 16*a*, we can see that the elapsed time for a match varies each time and the result of the match varies also each time, so the enjoyment of the arm-wrestling can be maintained for a long time.

FIG. 16*b* is a table summarizing results when two users played arm-wrestling 26 times each with the arm-wrestling robot of FIG. 14*a*. The table in FIG. 16*b* shows that the first user has 63% of human's winning probability and the second user has 75% of human's winning probability.

In addition, this invention is not limited to the above-mentioned example, and includes modification of further many in the range which does not deviate from the essence. While the invention has been shown and described with respect to the preferred embodiments, it will be understood by those skilled in the art that various changes and modifications may be made without departing from the spirit and scope of the invention as defined in the following claims.

INDUSTRIAL APPLICABILITY

The main functional characteristics of the arm-wrestling robot of the present invention are (i) the arm-wrestling robot generates automatically a force level appropriate to each person after sensing human's arm force, and therefore all persons with large or small arm force can enjoy the arm wrestling together, (ii) it's generated force pattern varies with each match, so one person can enjoy arm wrestling with the robot for a long time without being bored, and (iii) the winning average of the robot is determined randomly at the starting instant of the match, and also human's will to win the match influences the winning average of the robot.

With these characteristics, the present invention can be applied to an entertainment sector for user's enjoyment, a service sector for the senior health promotion, and an educational sector for student's curiosity.

The invention claimed is:

1. An arm-wrestling robot comprising:

an arm-force generation mechanism including:

a mechanical arm with a hand that a user grasps to play an arm-wrestling match;

an electric motor that provides torque to the mechanical arm according to motor control input signals;

a position/velocity sensor that detects angular position and angular velocity of the electric motor, and generates feedback signals related to the detected angular position and angular velocity; and a torque sensor that detects torque acting on the mechanical arm; and a control system coupled to the arm-force generation mechanism, wherein for each match between the arm-wrestling robot and the user, the control system: (i) detects an amount of arm-force generated by the user, (ii) generates at least one of a plurality of different game sub-scenarios, (iii) executes force feedback control logic to control force and motion of the mechanical arm according to the generated sub-scenario, and (iv) produces the motor control input signals to implement the generated sub-scenario, wherein the control system comprises:

an amplifier part that amplifies and conditions a low level voltage signal corresponding to the torque detected by the torque sensor;

a logic circuit part that conditions the feedback signals generated by the position/velocity sensor;

a memory part that stores a control program including control logic;

a control part that produces the motor control input signals using the control program stored in the memory part and the feedback signals generated by the position/velocity sensor; and a motor driving part that drives the electric motor according to the motor control input signals produced by the control part.

2. The arm-wrestling robot of claim 1, wherein the force feedback control logic controls the force and motion of the mechanical arm by automatically generating a torque command according to the generated sub-scenario, and wherein the generated sub-scenario has random characteristics in force increment and force duration.

3. The arm-wrestling robot of claim 1, wherein the arm-force generation mechanism further comprises:

a speed reducer connected to the electric motor, wherein the speed reducer decreases the angular velocity of the electric motor and increases the torque of the electric motor; and an adapter with a mechanical stopper that is installed between the speed reducer and the mechanical arm, and is utilized to restrict a range of motion of the mechanical arm in order to guarantee safety of the user.

4. The arm-wrestling robot of claim 1, wherein the control part further produces voice and image signals, and wherein the control system further comprises an output means part that drives a voice output means and an image output means using the voice and image signals produced by the control part.

5. The arm-wrestling robot of claim 3, wherein the adaptor with the mechanical stopper is utilized further to set an initial angle of the mechanical arm via low speed control of the electric motor.

6. The arm-wrestling robot of claim 3, wherein the arm-force generation mechanism further comprises a plurality of inclinometers on the adaptor in order to set an initial angle of the mechanical arm.

7. The arm-wrestling robot of claim 1, wherein the control system further comprises:

a plurality of ultrasonic sensors that detect the user approaching the arm-wrestling robot;

a pulse generation part that produces a pulse signal for the ultrasonic sensors; and a photoelectric sensor that detects the user sitting on a chair arranged near the arm-wrestling robot.

8. The arm-wrestling robot of claim 1, wherein the control system further comprises:

a motor power control part including a solid state relay that receives an initialization completion signal coming from the control part and generates a corresponding output signal; and a mechanical relay coupled to the solid state relay for receiving the output signal, wherein the mechanical relay connects the motor driving part and the power source according to the output signal.

9. A method to control an arm-wrestling robot during an arm-wrestling match, comprising:

initializing an arm-force generation mechanism and a control system;

setting an initial angle of a mechanical arm of the arm-wrestling robot;

detecting an approach of a user to the arm-wrestling robot using a plurality of ultrasonic sensors, and detecting the user sitting on a chair arranged in association with the arm-wrestling robot using a photoelectric sensor;

measuring an amount of arm-force generated by a user of the arm-wrestling robot during a specified time interval based on a signal coming from a torque sensor of the arm-force generation mechanism; and actuating the arm-force generation mechanism by force feedback control to execute an arm-wrestling sub-scenario.

10. The method of claim 9, wherein the steps of initializing and setting comprise:

transmitting an initialization completion signal to a motor power control part of the control system and transmitting an initial motor control input signal to a motor driving part of the control system;

applying a power source to the motor driving part of the control system after the motor power control part receives the initialization completion signal; and setting an initial absolute angle of the mechanical arm.

11. The method of claim 9, wherein the step of measuring an amount of arm-force generated by a user comprises:

increasing a torque acting on the mechanical arm up to a specified value;

determining whether a velocity of the mechanical arm is positive or negative;

increasing the torque acting on the mechanical arm if the velocity is positive;

decreasing the torque acting on the mechanical arm if the velocity is negative; and repeating the steps of determining, increasing and decreasing during the specified time interval to determine the amount of arm-force generated by the user.

12. The method of claim 9, wherein the step of actuating the arm-force generation mechanism comprises:

selecting a first sub-scenario among a plurality of different sub-scenarios;

calculating a will point of the user using an average arm-force calculated during execution of the selected sub-scenario;

selecting a second sub-scenario among the plurality of sub-scenarios according to the calculated will point;

deciding whether the selected second sub-scenario results in a winning, drawing, or losing scenario, wherein:

if the selected second sub-scenario results in the drawing scenario, the method further comprises returning to the step of calculating a will point of the user after completing force feedback control corresponding to the drawing scenario;

if the selected second sub-scenario results in the winning scenario, the method further comprises ending the match after completing force feedback control corresponding to the winning scenario; and if the selected second sub-scenario results in the losing scenario, the method further comprises ending the match after completing force feedback control corresponding to the losing scenario.

13. The method of claim 9, wherein the step of actuating the arm-force generation mechanism comprises:

adjusting the measured amount of arm-force generated by the user;

determining a sustain value randomly;

generating a sub-scenario with random force increment, random rising time, and random maintaining time;

executing the generated sub-scenario;

finishing the match if the user wins or loses the generated sub-scenario;

checking if the generated sub-scenario is completed, wherein:

if the generated sub-scenario is not completed, the method further comprises repeating the steps of executing, finishing and checking until the generated sub-scenario is completed;

if the generated sub-scenario is completed, the method further comprises checking if the sustain value equals zero, wherein:

if the sustain value does not equal zero, the method further comprises decreasing the sustain value by 1, and returning to the step of generating a sub-scenario; and if the sustain value does equal zero, the method further comprises decreasing the measured amount of arm-force generated by the user in a prescribed manner, and returning to the step of determining a sustain value randomly.

* * * * *

UNITED STATES PATENT AND TRADEMARK OFFICE

CERTIFICATE OF CORRECTION

PATENT NO. : 8,016,654 B2
APPLICATION NO. : 12/065041
DATED : September 13, 2011
INVENTOR(S) : Kang It is certified that error appears in the above-identified patent and that said Letters Patent is hereby corrected as shown below:

Claim 9 at col. 10, line 67 After "system" please add --of the arm-wrestling robot--.

Signed and Sealed this
Fourteenth Day of February, 2012

David J. Kappos

David J. Kappos
*Director of the United States Patent and Trademark Office*